US007913728B2

(12) United States Patent
Bettacchini

(10) Patent No.: US 7,913,728 B2
(45) Date of Patent: Mar. 29, 2011

(54) PLANER AND THICKNESSER

(75) Inventor: Marcello Bettacchini, Perugia (IT)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 12/424,669

(22) Filed: Apr. 16, 2009

(65) Prior Publication Data

US 2009/0211664 A1 Aug. 27, 2009

Related U.S. Application Data

(62) Division of application No. 11/068,300, filed on Feb. 28, 2005, now Pat. No. 7,527,080.

(30) Foreign Application Priority Data

Mar. 2, 2004 (GB) ..... 0404557.1

(51) Int. Cl.
*B27C 1/00* (2006.01)

(52) U.S. Cl. ..... 144/117.1; 144/129; 144/253.6; 144/253.8

(58) Field of Classification Search ..... 144/117.1, 144/129, 114.1, 116, 130, 253.1, 253.6, 253.8
See application file for complete search history.

(56) References Cited

U.S. PATENT DOCUMENTS 2,782,817 A * 2/1957 Steiner ..... 144/117.3
4,356,851 A * 11/1982 Glore ..... 144/253.8
5,533,557 A * 7/1996 Jedlicka et al. ..... 144/253.8
5,595,227 A * 1/1997 Varley ..... 144/253.6
5,662,019 A * 9/1997 Denman ..... 83/425
6,899,004 B1 * 5/2005 Miller ..... 83/446

FOREIGN PATENT DOCUMENTS

DE 9107890 U1 8/1991
GB 222090 * 9/1925
JP 52135498 * 11/1977

OTHER PUBLICATIONS

Frisch, Ulrich—European Search Report re EP10158984—May 11, 2010—Munich.

* cited by examiner

*Primary Examiner* — Bena Miller
(74) *Attorney, Agent, or Firm* — Michael Aronoff; Adan I Ayala

(57) ABSTRACT

A planer and thicknesser comprising a frame having a passageway that substantially extends through the frame. The planer and thicknesser further comprises an upper table having front and rear sections mounted on the frame, wherein a slot is located between the front and rear sections of the upper table, and a lower table moveably mounted within the passageway. The planer and thicknesser also comprises a cutting drum rotatably mounted within the frame such that a portion of the cutting drum projects upwardly through the slot and a portion of the cutting drum projects downwardly into the passage way. The planer and thicknesser also comprises a cover mounted above the upper table capable of being moved from a first position where it covers a portion of the cutting drum to a second position where it does not cover a portion of the cutting drum.

9 Claims, 25 Drawing Sheets

PLANER AND THICKNESSER

CROSS REFERENCE TO RELATED APPLICATIONS

Priority to British Application No. GB 04 045 57.1, filed Mar. 2, 2004 is claimed under 35 U.S.C. §119.

FIELD OF THE INVENTION

The present invention generally relates to planers and thicknessers.

BACKGROUND OF THE INVENTION

A typical planer and thicknesser comprises a rectangular, box-like frame comprising a horizontal rectangular upper table and a base connected to each other along their longer sides by two side walls. The horizontal upper table is located directly above the rectangular base. A first aperture is formed by one of the shorter ends of the upper table and by the base and one end of each of the two side walls. Similarly, a second aperture is formed on the opposite side of the rectangular box frame by the other shorter end of the upper table and the other end of the base, together with the other ends of each of the side walls. A passage way connects the two apertures to each other.

The upper table is constructed from two rectangular sections, a front section and a rear section. The two sections of the upper table are constructed from single rectangular sheets of metal having smooth top surfaces. The top surface of the front section is parallel to the top surface of the rear section. Both the top surfaces are smooth so that a work piece can be slideably moved across their surfaces. The height of the front section can be adjusted relative to the height of the rear section. The two sections are separated by a slot.

A horizontal lower table is movably located within the passage way. The plane of the lower table is parallel to that of the upper table. The lower table is constructed as a single rectangular sheet of metal having a smooth top surface. The lower table extends through the full length of the passage way from the first aperture to the second aperture. The width of the table is slightly less than that the width of the passage way. The table is mounted in such a manner that it can be moved vertically upwards or downwards, the top surface of the table remaining horizontal at all times during this process.

A cutting drum is rotatably mounted between the two side walls in such a manner that its axis of rotation is perpendicular to the plane of the side walls and parallel to the planes of the upper and lower tables. The cutting drum can be rotatably driven by an electric motor mounted within the base. The axis of rotation of the cutting drum is located below the upper table.

A part of the periphery of the cutting drum along its length extends upwardly through the slot between the front and rear sections of the upper table.

Each of the two cutting blades are mounted within a groove of the cutting drum which runs along the length of the cutting drum in well known manner parallel to the axis of rotation. The cutting blades of the cutting drum can be used to cut work pieces in well known manner which are either slideably moved across the upper table in one direction or are slideably moved across the lower table in the other direction.

The cutting drum is located so that, as the cutting drum rotates, the maximum height of the cutting blades mounted within the cutting drum through the slot are approximately the same as the height of the rear section of the upper table, the height of the rear section being fixed relative to the frame.

Two drive rollers are mounted on either side of the cutting drum between the side walls in such a manner that their axes of rotation are parallel to that of the cutting drum. The two drive rollers are rotatably driven by the same electric motor which is used to drive the cutting drum. The function of the two drive rollers is to move any work pieces which are fed into the rectangular passageway across the lower table and to engage the cutting blades at their lowest point as the rotating cutting drum rotates.

A planer and thicknesser can be used in two different modes of operation.

In the first mode of operation, a work piece is slideably moved across the upper table in order to remove the surface of the work piece which is adjacent to the smooth top surface of the upper table. The height of the front section of the upper table determines the amount of material which is to be removed from the work piece. First, the height of the front section is adjusted so that the cutting action of the rotating drum removes the right thickness of material from the lower surface of the work piece. Next, the cutting drum is then rotatingly driven by the electric motor. While the cutting drum is rotating, the work piece is slideably moved across the front section of the upper table until it engages the cutting blades of the cutting drum as they rotate. The work piece is then pushed onto the rear section of the upper table across the rotating cutting drum. As the work piece passes over the rotating blades of the cutting drum, the cutting blades remove material from the underside of the work piece.

In the second mode of operation, a work piece is slideably moved across the smooth surface of the lower table in order to remove the top surface of the work piece. The height of the lower table within the passageway determines the amount of material which will be removed from the top surface of the work piece as it is passes through the passageway. First, the height of the lower table is adjusted so that the cutting action of the rotating drum removes the correct thickness of material from the top surface of the work piece. Next, the cutting drum is then rotatingly driven by the electric motor. While the cutting drum is rotating, the work piece is slideably moved across the lower table, until the upper surface of the work piece engages the cutting blades of the cutting drum as a cutting drum rotates. As the work piece passes under the cutting blades, the cutting blades remove material from the topside of the work piece. The two drive rollers, which are also being rotatingly driven by the electric motor, help move the work piece through the passageway.

However, there are a number of problems associated with existing designs of planer and thicknessers.

The object of the present invention is to improve the design and construction of the planer and thicknessers.

SUMMARY OF THE INVENTION

According to a first aspect of the present invention, there is provided a planer and thicknesser comprising a frame having a passage way which extends through the frame from one aperture in a wall of the frame to another aperture in a wall of the frame; an upper table having front and rear sections mounted on the frame in such a manner as to form a slot between the front and rear sections of the upper table; a cutting drum rotatably mounted within the frame such that an upper lengthwise section of the periphery of the cutting drum projects upwardly through the slot and a lower lengthwise section of the periphery of the cutting drum projects downwardly into the passage way; a lower table, substantially parallel to the upper table, mounted either within the passageway or forms the base of the passageway, below the cutting drum; a cover mounted above the upper table capable of being moved from a first position where it is adjacent to the upper table and covers the lengthwise section of the periphery of the cutting drum which projects upwardly through the slot to a second position where it is above and away from the upper table; wherein the cover can be moved perpendicularly relative to the plane of the upper table from the first position to the second position.

According to a second aspect of the present invention, there is provided a planer and thicknesser comprising a frame having a passage way which extends through the frame from one aperture in a wall of the frame to another aperture in a wall of the frame; an upper table having front and rear sections which are mounted on the frame in such a manner as to form a slot between the front and rear sections of the upper table; a cutting drum rotatably mounted within the frame such that an upper lengthwise section of the periphery of the cutting drum projects upwardly through the slot and a lower lengthwise section of the periphery of the cutting drum projects downwardly into the passage way; a lower table, substantially parallel to the upper table, mounted either within the passageway or forms the base of the passageway, below the cutting drum; wherein there is provided at least one extension to the lower table which attaches to one end of the lower table and extends from the end of lower table through one of the apertures and away from the frame.

According to a third aspect of the present invention, there is provided a planer and thicknesser comprising a frame having a passage way which extends through the frame from one aperture in a wall of the frame to another aperture in a wall of the frame; an upper table having front and rear sections which are mounted on the frame in such a manner as to form a slot between the front and rear sections of the upper table; a cutting drum rotatably mounted within the frame such that an upper lengthwise section of the periphery of the cutting drum projects upwardly through the slot and a lower lengthwise section of the periphery of the cutting drum projects downwardly into the passage way; a lower table, substantially parallel to the upper table, mounted either within the passageway or forms the base of the passageway, below the cutting drum; a side fence assembly for guiding a work piece across the upper table, the side fence assembly comprising a pivotal guard, wherein the pivotal guard is mounted on to the frame through a tilt mechanism, the tilt mechanism comprises at least one bracket connected to the guard and a second bracket connected to the frame; one bracket comprising an arcuate slot; the second bracket comprising an aperture; the two brackets being moveable relative to each other so that the aperture can align with any part of the arcuate slot; and a holding member which passes through the aperture and arcuate slot and is capable of releasably locking one bracket to the other bracket preventing any relative movement between the two.

According to a fourth aspect of the present invention, there is provided a planer and thicknesser comprising a frame having a passage way which extends through the frame from one aperture in a wall of the frame to another aperture in a wall of the frame; an upper table having front and rear sections mounted on the frame in such a manner as to form a slot between the front and rear sections of the upper table; a cutting drum rotatably mounted within the frame such that an upper lengthwise section of the periphery of the cutting drum projects upwardly through the slot and a lower lengthwise section of the periphery of the cutting drum projects downwardly into the passage way; a lower table, substantially parallel to the upper table, mounted either within the passageway or forms the base of the passageway, below the cutting drum; a side fence assembly for guiding a work piece across the upper table, the side fence assembly comprises a guard; wherein the guard is connected to the frame through a slide mechanism to allow the guard to be moved across the upper table, the slide mechanism comprising a slide piece slideably mounted on a guide support; the guide support comprising a channel having outwardly sloping walls; a part of the slide piece being located within and capable of sliding along the channel; and a locking mechanism which can lock the guide support to slide piece.

According to a fifth aspect of the present invention, there is provided a side fence assembly for guiding a work piece across the upper table of a planer and thicknesser; the side fence assembly comprising a pivotal guard; wherein the pivotal guard is mounted on to the frame through a tilt mechanism, the tilt mechanism comprising at least one bracket connected to the guard and a second bracket connected to the frame; one bracket comprising an arcuate slot; the second bracket comprising an aperture; the two brackets moveable relative to each other so that the aperture can be aligned with any part of the arcuate slot; and a holding member which passes through the aperture and arcuate slot and is capable of releasably locking one bracket to the other to prevent any relative movement between the two brackets.

According to a sixth aspect of the present invention, there is provided a side fence assembly for guiding a work piece across an upper table of a planer and thicknesser, the side fence assembly comprising a guard; wherein the guard is mounted on to the frame through a slide mechanism to allow the guard to be moved across the upper table, the slide mechanism comprising a slide piece slideably mounted on a guide support; the guide support comprising a channel having outwardly sloping walls; a part of the slide piece being located within and capable of sliding along the channel; and a locking mechanism which can lock the guide support to slide piece.

According to a seventh aspect of the present invention, there is provided a planer and thicknesser comprising a frame having a passage way which extends through the frame from one aperture in a wall of the frame to another aperture in a wall of the frame; an upper table having front and rear sections mounted on the frame in such a manner as to form a slot between the front and rear sections of the upper table; a cutting drum rotatably mounted within the frame such that an upper lengthwise section of the periphery of the cutting drum projects upwardly through the slot and a lower lengthwise section of the periphery of the cutting drum projects downwardly into the passage way; a lower table, substantially parallel to the upper table, mounted either within the passageway or forms the base of the passageway, below the cutting drum; wherein the front section of the upper table is mounted onto the frame through a height adjustment mechanism; wherein the height adjustment mechanism comprises a guide mechanism to control the direction of movement of the front section relative to the frame and a drive mechanism to enable a person to move the front section; the guide mechanism comprises a telescopic guide comprising a first part mounted onto the frame and a second part telescopically connected to the first part on one end and mounted to the front section of the upper table on the other end.

According to an eighth aspect of the present invention, there is provided a planer and thicknesser comprising a frame having a passage way which extends through the frame from one aperture in a wall of the frame to another aperture in a wall of the frame; an upper table having front and rear sections mounted on the frame in such a manner as to form a slot between the front and rear sections of the upper table; a cutting drum rotatably mounted within the frame such that an upper lengthwise section of the periphery of the cutting drum projects upwardly through the slot and a lower lengthwise section of the periphery of the cutting drum projects downwardly into the passage way; a lower table, substantially parallel to the upper table, mounted either within the passageway or forms the base of the passageway, below the cutting drum; two rollers located within the passageway; and a motor for rotatingly driving the rollers and cutting drum, wherein the motor is capable of rotatingly driving a drive gear via a belt which in turn drives a driven gear which rotatingly drives a drive cog, the drive cog in turn rotatingly drives a chain which engages a plurality of cogs mounted on the ends of each of the rollers to rotate the rollers.

According to a ninth aspect of the invention, there is provided a planer and thicknesser comprising a frame having a passage way which extends through the frame from one aperture in a wall of the frame to another aperture in a wall of the frame; an upper table having front and rear sections mounted on the frame in such a manner as to form a slot between the front and rear sections of the upper table; a cutting drum rotatably mounted within the frame such that an upper lengthwise section of the periphery of the cutting drum projects upwardly through the slot and a lower lengthwise section of the periphery of the cutting drum projects downwardly into the passage way; a lower table, substantially parallel to the upper table, mounted either within the passageway or forms the base of the passageway, below the cutting drum; and a dust extractor; wherein the dust extractor is capable of being connected to the underside of the upper table when the upper table is being used and being connected to top of the upper table when the lower table is being used.

BRIEF DESCRIPTION OF THE DRAWINGS

An embodiment of each of the above inventions will now be described with reference to the accompanying drawings of which.

DETAILED DESCRIPTION OF THE PREFERRED EMBODIMENTS

Figure 1:
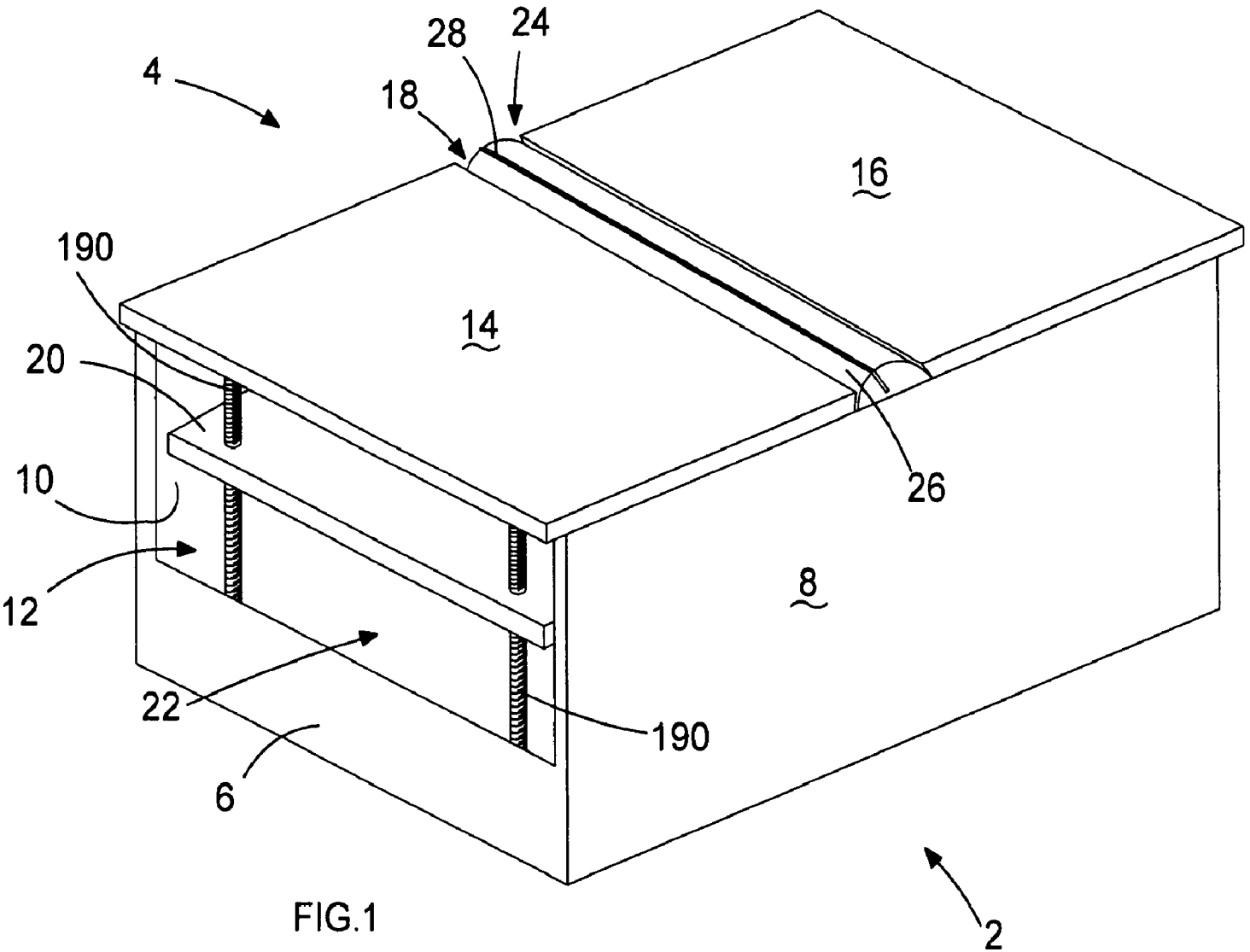
FIG. 1 shows a perspective view of a planer and thicknesser.

The planer and thicknesser of the present invention comprises a rectangular, box like frame 2 comprising a horizontal rectangular upper table 4 and a rectangular base 6 connected to each other along their longer sides by two vertical sidewalls 8, 10. Preferably, the horizontal upper table 4 is located above and runs parallel to the rectangular base 6. A first rectangular aperture 12 may be formed by one of the shorter ends of the upper table 4 and of the base and one end of each of the two side walls 8, 10. Similarly, a second rectangular aperture (not shown) may be formed on the opposite side of the rectangular box frame 2 by the other two shorter ends of the upper table 4 and rectangular base 6 and the other ends of each of the side walls. Preferably, a passage way 22, of rectangular cross-section, connects the two rectangular apertures 12 to each other, the two rectangular apertures 12 being substantially parallel to each other.

The upper table 4 is preferably constructed from two rectangular sections, a front section 14 and a rear section 16. The two sections 14, 16 of the upper table are constructed from single rectangular sheets of metal having substantially smooth top surfaces. The top surface of the front section may be substantially parallel to the top surface of the rear section. Both the top surfaces are substantially smooth so that a work piece can be slideably moved across their surfaces. The height of the front section 14 can be adjusted relative to the height of the rear section 16. The mechanism by which the height is adjusted will be described in more detail below. The two sections 14, 16 are separated by a slot 18.

In a preferred embodiment, a horizontal lower table 20 is movably located within the rectangular passage way 22. The plane of the lower table is substantially parallel to that of the upper table. The lower table 20 may be constructed as single rectangular sheet of metal having a substantially smooth top surface. The lower table 20 preferably extends through the full length of the passage way 22 from the first aperture 12 to the second aperture. The width of the table 20 is slightly less than that the width of the passage way 22. In a preferred embodiment, the table is mounted in such a manner that it may be moved vertically upwards or downwards with the top surface of the table 20 remaining horizontal at all times during this process. The mechanism by which the lower table 20 is moved up and down is described in more detail below.

In a preferred embodiment, a cutting drum 24 is rotatably mounted between the two side walls 8, 10 in such a manner that its axis of rotation is perpendicular to the plane of the side walls 8, 10 and parallel to the planes of the upper and lower tables 4, 20. The cutting drum 24 can be rotatably driven by an electric motor (not shown) mounted within the base 6 of the rectangular box like frame 2. The mechanism by which the cutting drum 24 is rotatably driven by the electric motor is described in more detail below.

A part 26 of the periphery of the cutting drum, along its length, preferably extends through the slot 18 between the front and rear sections 14, 16 of the upper table 4.

In a preferred embodiment, two cutting blades 28 are mounted within a groove of the cutting drum 24 which runs along the length of the cutting drum 24, in a well known manner, parallel to the axis of rotation. The cutting blades 28 of the cutting drum can be used to cut work pieces in a well known manner which are either slideably moved across the upper table 4 in one direction or are slideably moved across the lower table 20 in the other direction.

The cutting drum 24 is located so that, as the cutting drum 24 rotates, the maximum height of the cutting blades 28 mounted within the cutting drum 24 through the slot 18 are the same as the height of the rear section 16 of the upper table, the height of the rear section 16 being fixed.

Two drive rollers 30, 32 (not shown) are preferably mounted on either side of the cutting drum between the side walls in such a manner that their axes of rotation are parallel to that of the cutting drum 24. The two drive rollers 30, 32 are rotatably driven by the same electric motor which is used to drive cutting drum 24. The mechanism by which the electric motor rotatingly drives the two drive rollers 30, 32 is described in more detail below. The function of the two drive rollers 30, 32 is to move any work pieces that are fed into the rectangular passageway 22 across the lower table 20 and engage the cutting blades 28 as they pass below the axis of rotation of the rotating cutting drum 24 at its lowest point.

The planer and thicknesser may be used in two different modes of operation.

In a first mode of operation, a work piece is slideably moved across the upper table 4 in order to remove the surface of the work piece that is adjacent to the smooth top surface of the upper table 4. The height of the front section 14 of the upper table 4 determines the amount of material to be removed from the work piece. The height of the front section 14 may be adjusted so that the cutting action of the rotating drum 24 removes the right thickness of material from the lower surface of the work piece. The cutting drum 24 is rotatingly driven by the electric motor. While the cutting drum 24 is rotating, the work piece is slideably moved across the front section 14 of the upper table until it engages the cutting blades 28 of the cutting drum 24 as they rotate, which repeatedly pass through the slot 18 between the front 14 and rear 16 sections. The work piece is slideably moved onto the rear section 16 of the upper table across the rotating cutting drum 24. As the work piece passes over the rotating blades 28 of the cutting drum 24, the cutting blades 28 remove material from the underside of the work piece.

In a second mode of operation, a work piece is slideably moved across the smooth surface of the lower table 20 in order to remove the top surface of the work piece. The height of the lower table 20 within the passageway 22 determines the amount of material which will be removed from the top surface of the work piece as the work piece passes through the passageway 22. The height of the lower table may be adjusted so that the cutting action of the rotating drum 24 removes the correct thickness of material from the top surface of the work piece. The cutting drum 24 is rotatingly driven by the electric motor. While the cutting drum 24 is rotating, the work piece is slideably moved across the lower table 20, until the upper surface of the work piece engages the cutting blades 28 of the cutting drum 24 as the cutting drum 24 rotates. As the work piece passes under the cutting blades 28, the cutting blades 28 remove material from the top surface of the work piece. The two drive rollers 30, 32, which are also being rotatingly driven by the electric motor, help move the work piece through the passageway 22.

Figure 2:
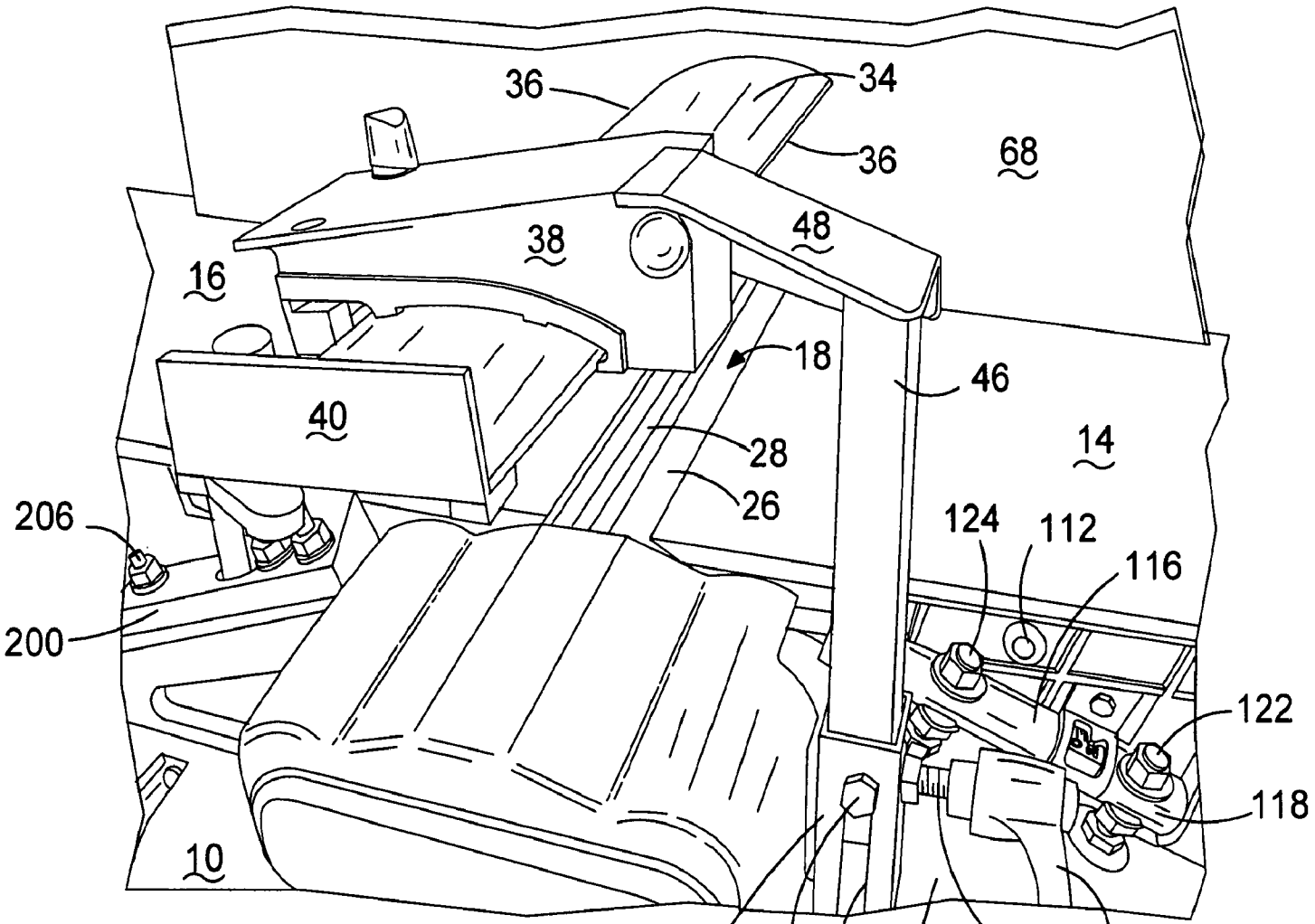
FIG. 2 shows a perspective view of a cover which can be used with a slot through which the periphery of a rotating cutting drum and cutting blades project on an upper table when the cutting drum is rotating.
Figure 3:
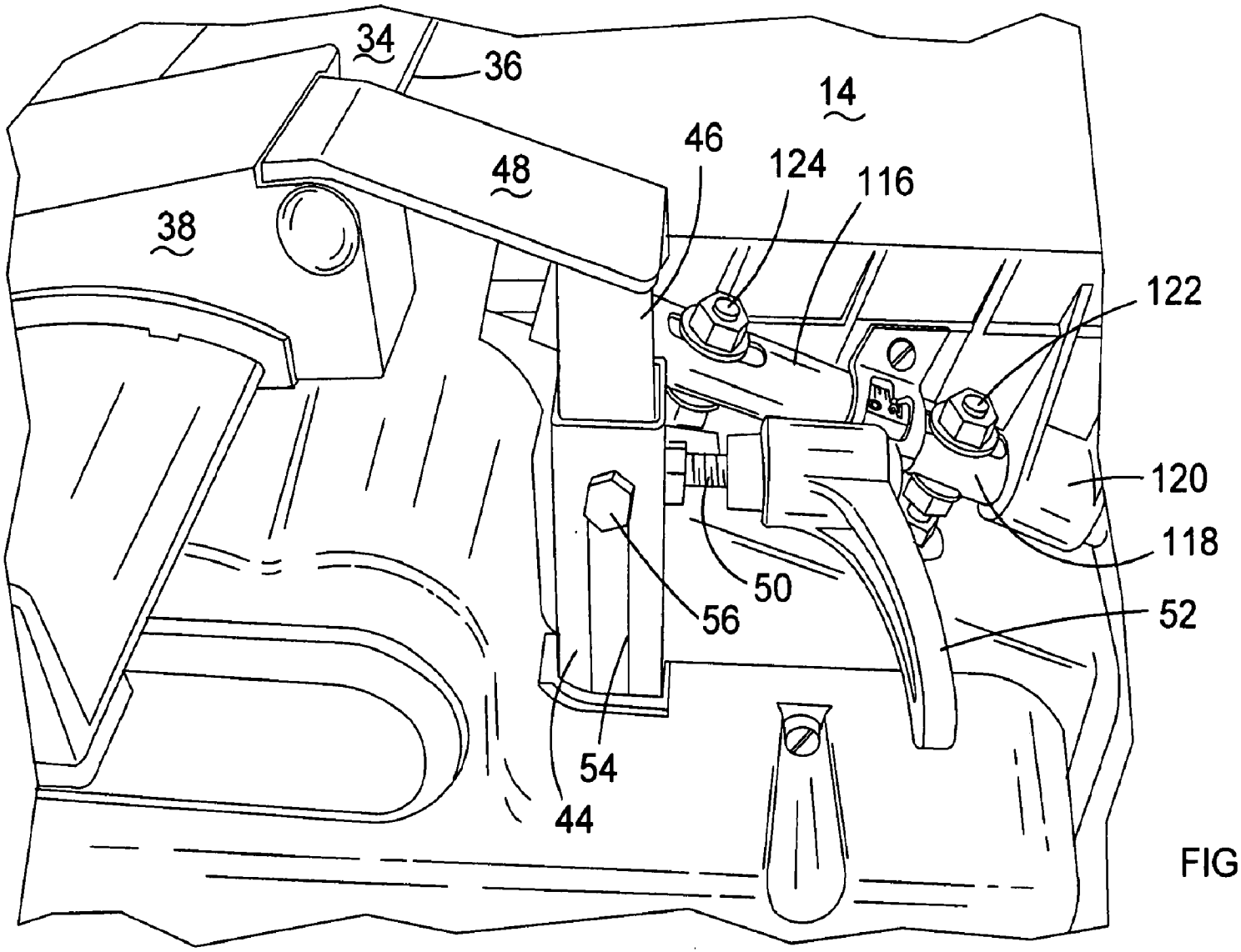
FIG. 3 shows a perspective view of a height adjustment mechanism for the cover of FIG. 2.

When the planer and thicknesser is being used in the second mode of operation, it is desirable to place a cover over the slot 18 in the upper table through which the periphery of the rotating cutting drum 24 and the cutting blades 28 project. The construction of such a cover, according to a preferred embodiment of the present invention, will now be described with reference to FIGS. 2 and 3.

In a preferred embodiment, the cover comprises a substantially curved rectangular shield 34 which may extend across the width of the planer and thicknesser above the upper table 4. The curved shield 34 may have a length that is slightly longer than the width of the two sections 14, 16 of the upper table 4. The width of the curved shield 34 preferably is sufficient to fully cover the slot 18 between the front and rear sections 14,16 of the upper table 4 and to enable the longer edges 36 of the curved shield 34 to engage the front and rear sections 14,16 of the upper table. Preferably, the shield 34 is curved so that when it is placed against the upper table 4, with the lengthwise edges 36 of the curved shield engaging the front and rear sections 14,16 of the upper table, it surrounds part 26 of cutting drum 24, and the cutting blades 28 which protrude through the slot 18 between the front and rear sections 14,16, without having any contact with the cutting blades 28 or the cutting drum 24, allowing the cutting drum 24 to freely rotate when the shield 34 is placed over the slot.

In a preferred embodiment, the curved shield 34 is slidably supported by mount 38. The curved shield 34 is capable of sliding within the mount 38 in a direction parallel to that of the axis of rotation of the cutting drum 24 and longitudinal axis of the slot 18 i.e. across the width of the upper table 4. This enables the curved shield 34 to be moved out of the way from the slot 18 to allow the upper table 4 to be used when the planer and thicknesser is being used in its first mode of operation. At one end of the curved shield 34, there preferably is a stop 40 which prevents the curved shield from sliding too far through the mount 38. A threaded bolt (not shown) threadably engages the mount 38 so that rotation of the bolt causes the bolt to screw into or out of the mount 38 vertically. When the bolt is screwed into the mount 38, the lower end of the bolt engages with the upper surface of the curved shield 34 to lock the curved shield 34 in position relative to the mount 38 in order to prevent it from sliding within the mount. A knob 42 (not shown) may be attached to the opposite upper end of the threaded bolt to enable the user to screw the bolt into or out of the mount 38.

In a preferred embodiment, the mount 38 is attached to a side wall 10 of the planer and thicknesser via a telescopic frame. The frame enables a user to adjust the height of the mount 38, and hence the curved shield 34. The frame preferably comprises two sections, a lower frame section 44 comprising a lower metal tube of square cross-section mounted on the side wall 10 of the planer and thicknesser so that the longitudinal axis of the lower metal tube is substantially vertical, and an upper frame section 46 comprising an upper metal tube similarly of square cross-section, and a horizontal metal bar 48. The upper metal tube 46 has a smaller cross-sectional area to enable it to slide into or out of the lower metal tube 44. A hole (not shown) may be formed in a side of the lower frame section 44 which is threaded to allow a bolt 50 to be screwed into or out of the lower metal tube 44. A handle 52 can be attached to one end of the bolt 50. The bolt 50 is used to secure the position of the upper metal tube 46 within the lower metal tube 44 by having the end of the bolt 50, within the lower metal tube 44, engage a side of the upper metal tube 46.

The metal bar 48, which extends sideways from the upper metal tube 46 of the upper frame section, connects the mount 38 to the upper metal tube 46.

In use, an operator is able to lower or raise the mount 38, thereby lowering or raising the curved shield 34 by unscrewing the bolt 50, using the handle 52, so that the end of the bolt 50 disengages from the side of the of the upper metal tube 46. The operator can then slide the upper metal tube into or out of the lower metal tube 44 to the desired position, and then screw the bolt 50 into the lower metal tube 44 so that the end engages with the side of the upper metal tube 46, thereby locking it and the mount 38 at a desired height.

A vertical elongate slot 54 may be formed in another wall of the lower metal tube 44. A second bolt 56 is screwed into the side of the upper metal tube 46, the head of which passes through the slot 54. The function of the slot 54 and the bolt 56 is to limit the range of vertical movement of the upper metal tube 46 within the lower metal tube 44 and also to prevent it from being removed from the lower metal tube 44.

By adjusting the height of the mount 38 and sliding the curved shield 34 within the mount 38, an operator is able to move the curved shield 34 from a position that covers the part 26 of the rotating cutting drum 24 and blades 28 projecting upwardly through the slot 18, to a position where it is out of the way of the part 26 of cutting drum 24 and cutting blades 28 projecting upwardly through the slot 18, to allow the upper table 4 to be freely used in the first mode of operation of the planer and thicknesser.

Figure 4:
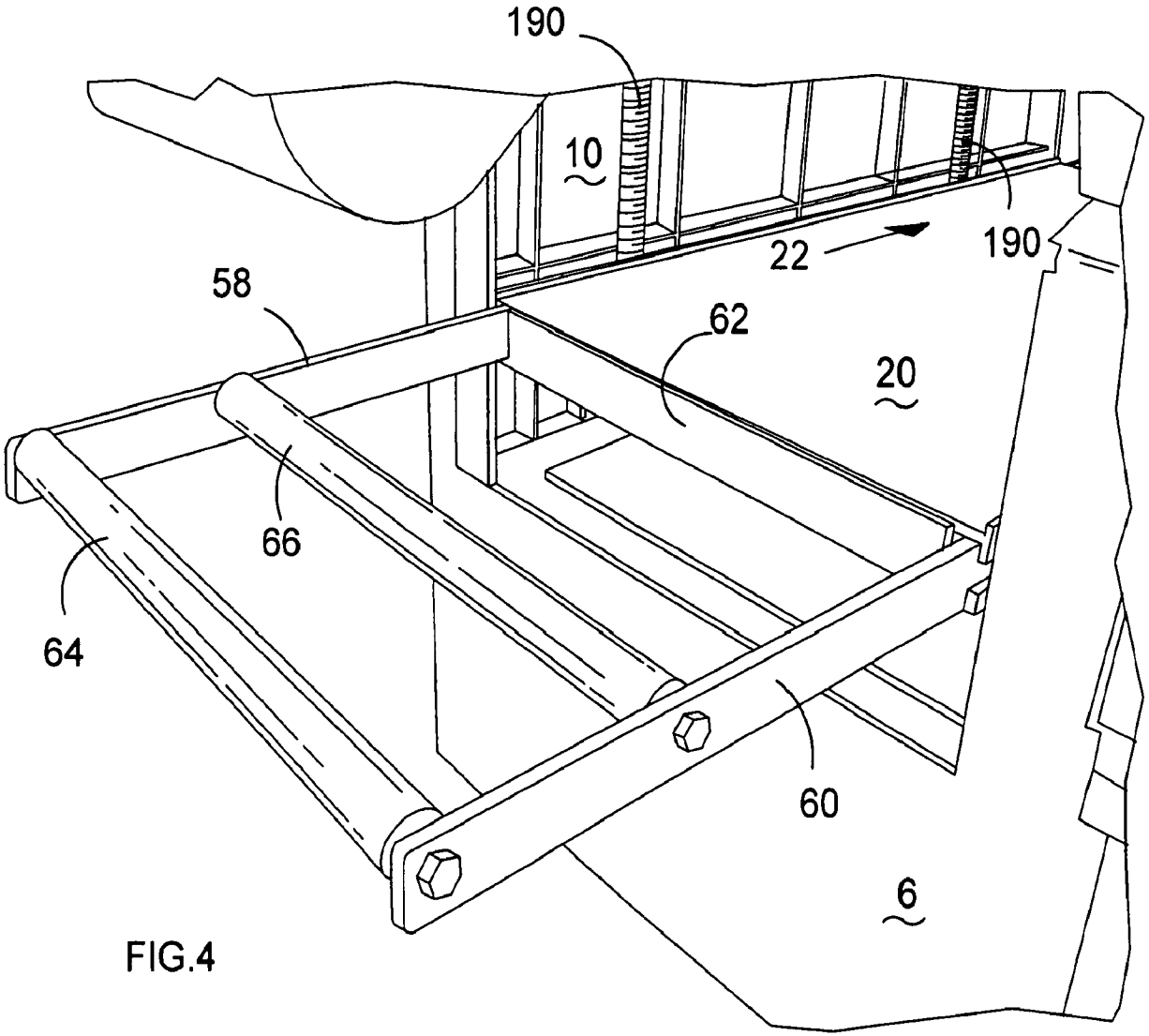
FIG. 4 shows a perspective view of an extension to a lower table.

The construction of an extension to the lower table 20 of a preferred embodiment of the present invention will now be described with reference to FIG. 4.

In a preferred embodiment, the extension comprises two extension bars 58, 60 of the same shape attached to the end 62 of the lower table 20, which extend horizontally and parallel to each other in the plane of the lower table 20 away from the lower table 20 out through one of the apertures 12 and away from the rectangular box frame 2. Preferably, two extension rods 64, 66 connect the two extension bars 58, 60. The two extension rods 64, 66 are fixed in parallel, one rod 64 being connected between the two ends of the extension bars 58, 60 and the other rod 66 being attached between the two bars 58, 60 part way along the length of the two bars.

Both the front 14 and rear 16 sections of the upper table 4 of the planer and thicknesser are securely attached to the rectangular box frame 2 (though the height of the front section 14 can be adjusted relative to the rectangular box frame). As such, access to the lower table 20 by the operator is made difficult. This results in the operator having difficulty in feeding the work piece into the aperture 12 prior to it being passed through the passageway 22. By providing an extension to the lower table 20, its enables the operator to feed the work piece into the planer and thicknesser when it is being used in its second mode of operation with greater ease.

The construction of the side fence assembly according to a preferred embodiment of the present invention will now be described with reference to FIGS. 5 through 9.

In a preferred embodiment, mounted on the side of the rectangular box frame 2 adjacent the side of the upper table 4, is a side fence assembly. The side fence assembly preferably comprises a guard 68 which extends along a substantial part of the length of the upper table 4. The guard 68 has a substantially smooth surface 70 along which a work piece can be slideably moved as it is passed over the upper table 4. The function of the side fence assembly is to assist the operator in guiding the work piece over the upper table 4 when removing material from the lower surface of the work piece. The operator can push the work piece against the smooth surface 70 of the guard 68 and then slide the work piece along the surface 70 of the guard in order to control the movement of the work piece.

Figure 6:
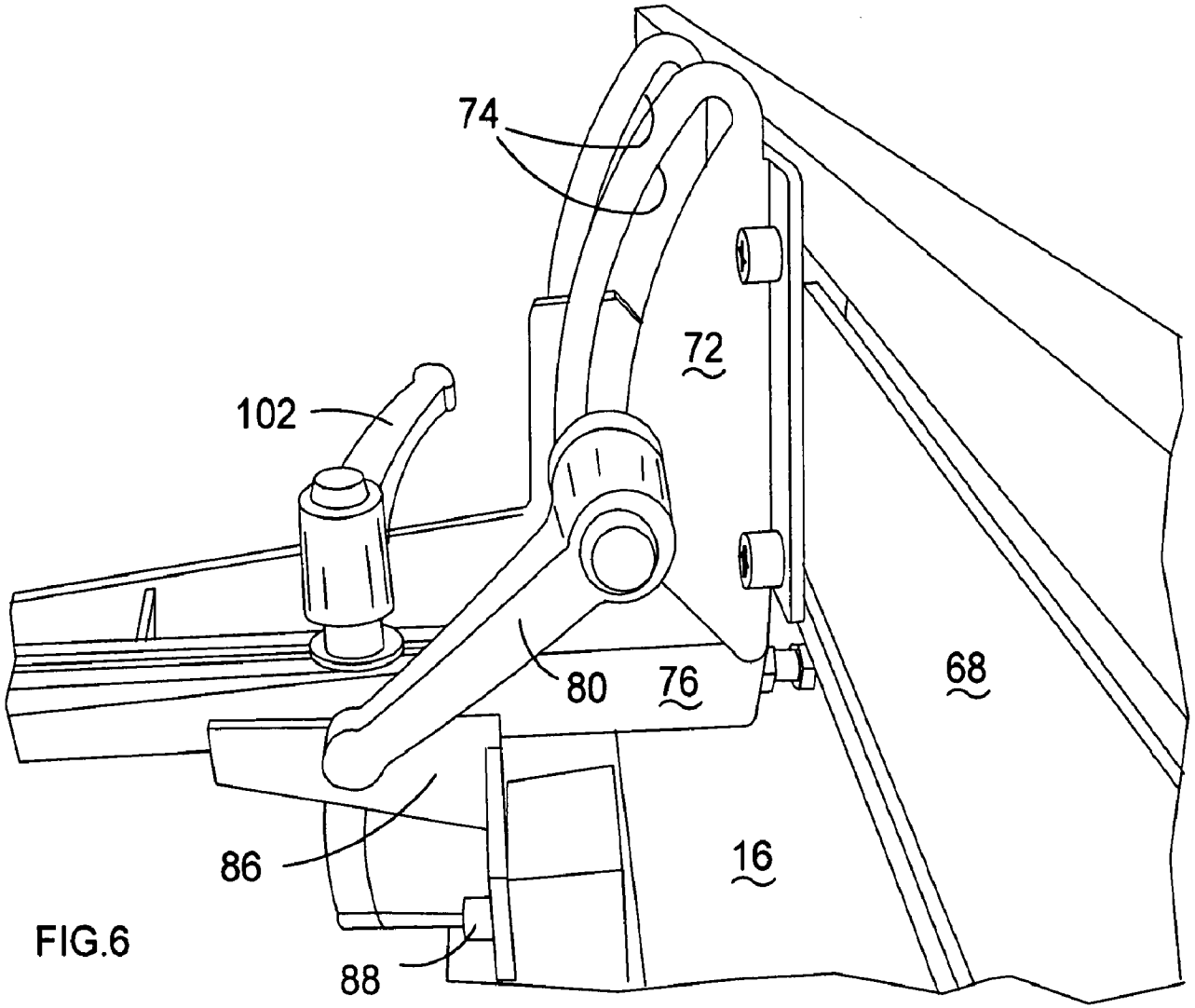
FIG. 6 shows a side view of a tilt mechanism of the side fence assembly with a guard at a first angle of tilt.
Figure 7:
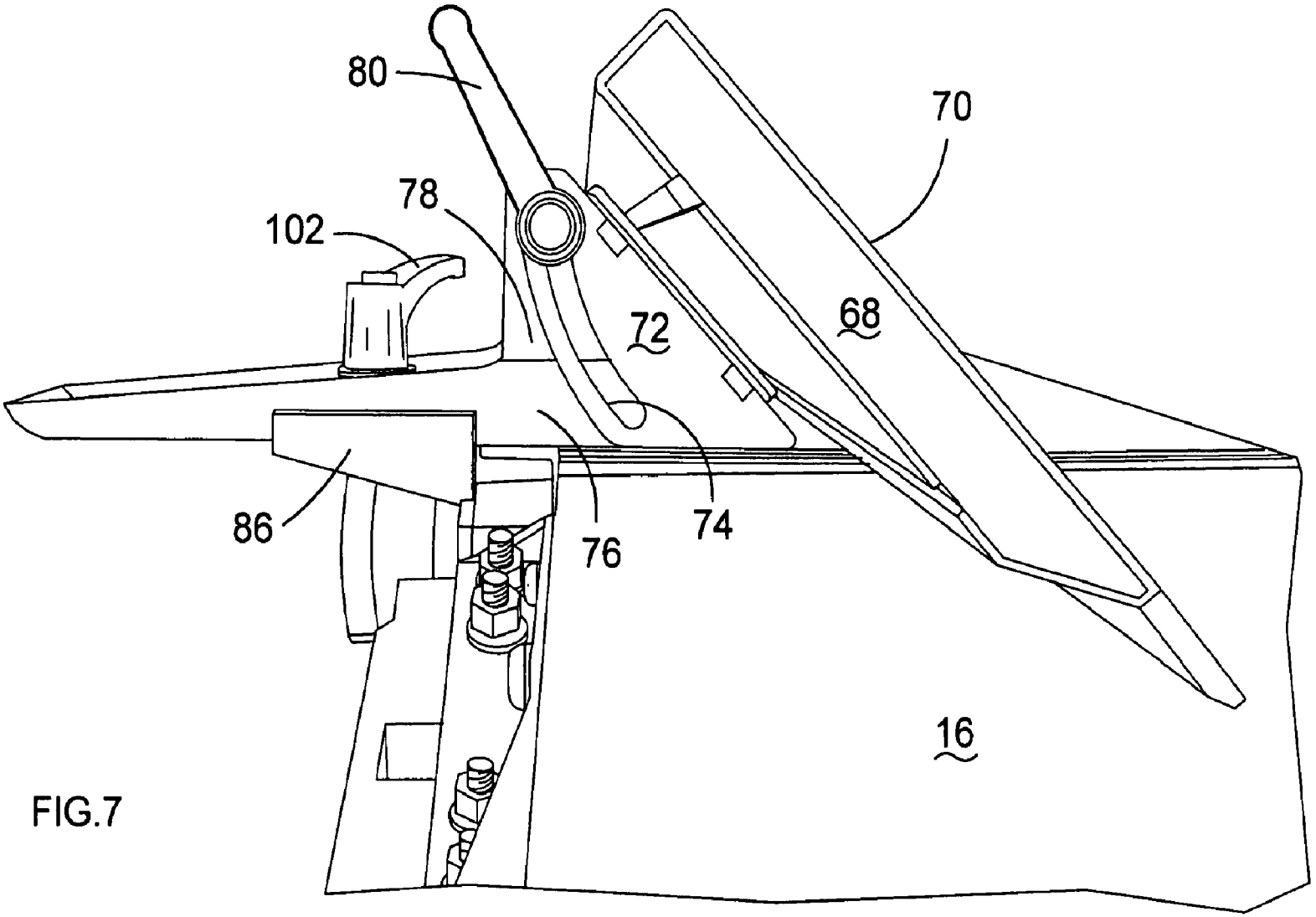
FIG. 7 shows a side view of the tilt mechanism of the side fence assembly with the guard at a second angle of tilt.

The smooth surface 70 of the guard 68 is capable of being angled relative to the plane of the upper surface of the upper table 4 through a range of angular positions. This range of positions include having the smooth surface 70 of the guard 68 being perpendicular to the plane of the upper table 4 as shown in FIG. 6 or at an angle where the guard 68 is approaching the 45 degrees to the plane of the upper table 4 as shown in FIG. 7. The mechanism by which the guard 68 can be tilted relative to the plane of the upper table 4 is herein referred to as the tilt mechanism. The tilt mechanism preferably only allows the surface 70 of the guard 68 to be pivoted about a horizontal axis. In addition, the guard 68 can be moved backwards and forwards across the width of the surface of the upper table 4 in a direction which is parallel to the axis of rotation of the rotating cutting drum 24. The mechanism by which the guard 68 is moved relative to the upper table 4 is referred to as the slide mechanism. The slide mechanism does not enable the guard 68 to pivot in any way.

The tilt mechanism will now be described in more detail with reference to FIGS. 5, 6 and 7.

Figure 5:
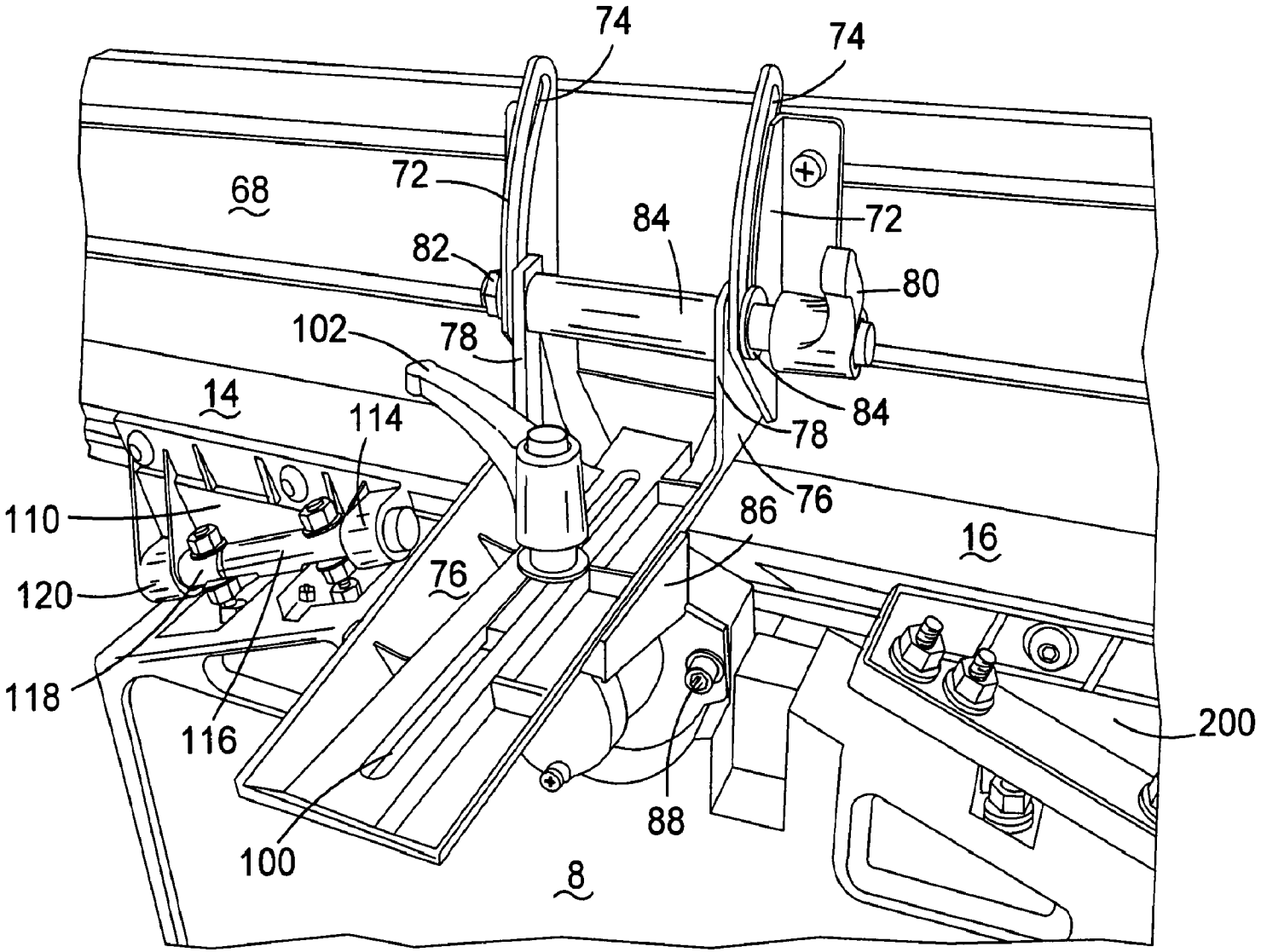
FIG. 5 shows a perspective view of a side fence assembly.

Referring to FIG. 5, in a preferred embodiment, two brackets 72 are attached to the rear of the guard 68. The brackets 72 are preferably mounted side by side, in parallel to each other, and project outwardly from the guard 68. Each bracket 72 may be manufactured from a sheet of metal. An arcuate slot 74 is formed in each of the brackets 72 which runs from the top of the bracket to the base of the bracket in a curved manner as shown in FIG. 7. The arcuate slot 74 in each bracket 72 is located in a corresponding position to the arcuate slot 74 in the other bracket in a symmetrical fashion.

In a preferred embodiment, the slide mechanism, which is described in more detail below, comprises a slide piece 76. The slide piece 76 may be formed from cast metal. Formed on one end of the slide piece are two preferably integral brackets 78 which extend upwardly and in parallel to each other. An aperture is formed in each of the brackets which is aligned with the aperture in the other bracket. The two brackets 78 of the slide piece 76 may be located between the two brackets 72 attached to the rear of the guard 68. Each of the brackets 78 on the slide piece may be flush with a corresponding bracket 72 mounted on the rear of the guard 68 as shown.

Preferably, a bolt (not visible) passes through the arcuate slot 74 of one of the brackets 72 attached to the rear of the guard 68, through the aperture formed in one of the brackets 78 on the slide piece 76 which is flush with that bracket 72, across the gap between the two integral brackets 78 on the slide piece 76, through the aperture of the other bracket 78 on the slide piece 76, and through the arcuate slot 74 of the second bracket 72 mounted on the rear of guard 68 flush with that bracket 78. A handle 80 may be attached to one end of the bolt and a nut 82 may be screwed onto the other end.

In a preferred embodiment, between the handle 80 and the side of the bracket 72 on the guard 68 adjacent the handle 80 is a washer 84 having an outer diameter which is greater than the width of the arcuate slots 74 and an inner diameter which is less than that of the base of the handle 80. Located on the other end of the bolt between the nut 82 and the other bracket 72 mounted on the rear of the guard 68 adjacent the nut 82, is a second washer (not visible) which also has a diameter greater than the size of the arcuate slot 74 in that bracket 72 and an inner diameter less than the outer diameter of the nut 82. The bolt passes through the length of a metal tube 84 which is located between the two brackets formed on the slide piece 76. The diameter of the tube 84 is greater than that of the holes formed through the brackets 78 in the slide piece 76. The length of the tube 84 is the same as that of the size of the gap between the brackets 78 on the slide piece 76.

In a preferred embodiment, the tilt mechanism is operated by tightening the bolt and nut 82 using the handle 80 which causes each pair of adjacent brackets 72, 78 mounted on the rear of the guard 68 and the slide piece 76 to be sandwiched between the adjacent end of the tube 84 surrounding the bolt and the washer located on the other side of the adjacent pair of brackets 72, 78. In order to loosen the tilt mechanism, the bolt and nut 82 are unscrewed using the handle 80, releasing the sandwiching pressure on the two pair of brackets 72, 78 allowing the guard 68 to be tilted to an appropriate angle. The guard 68 is tilted by sliding the bolt within the arcuate slots 74 until the guard is at the correct position. Once located at the appropriate angle, the bolt and nut 82 are tightened again, reapplying the sandwiching force onto the two adjacent brackets 72, 78 preventing any further movement of the guard 68. FIG. 6 shows a guard 68 in a vertical position while FIG. 7 shows a guard is an angled position with the bolt located in a different part of the arcuate slots 74.

Figure 8:
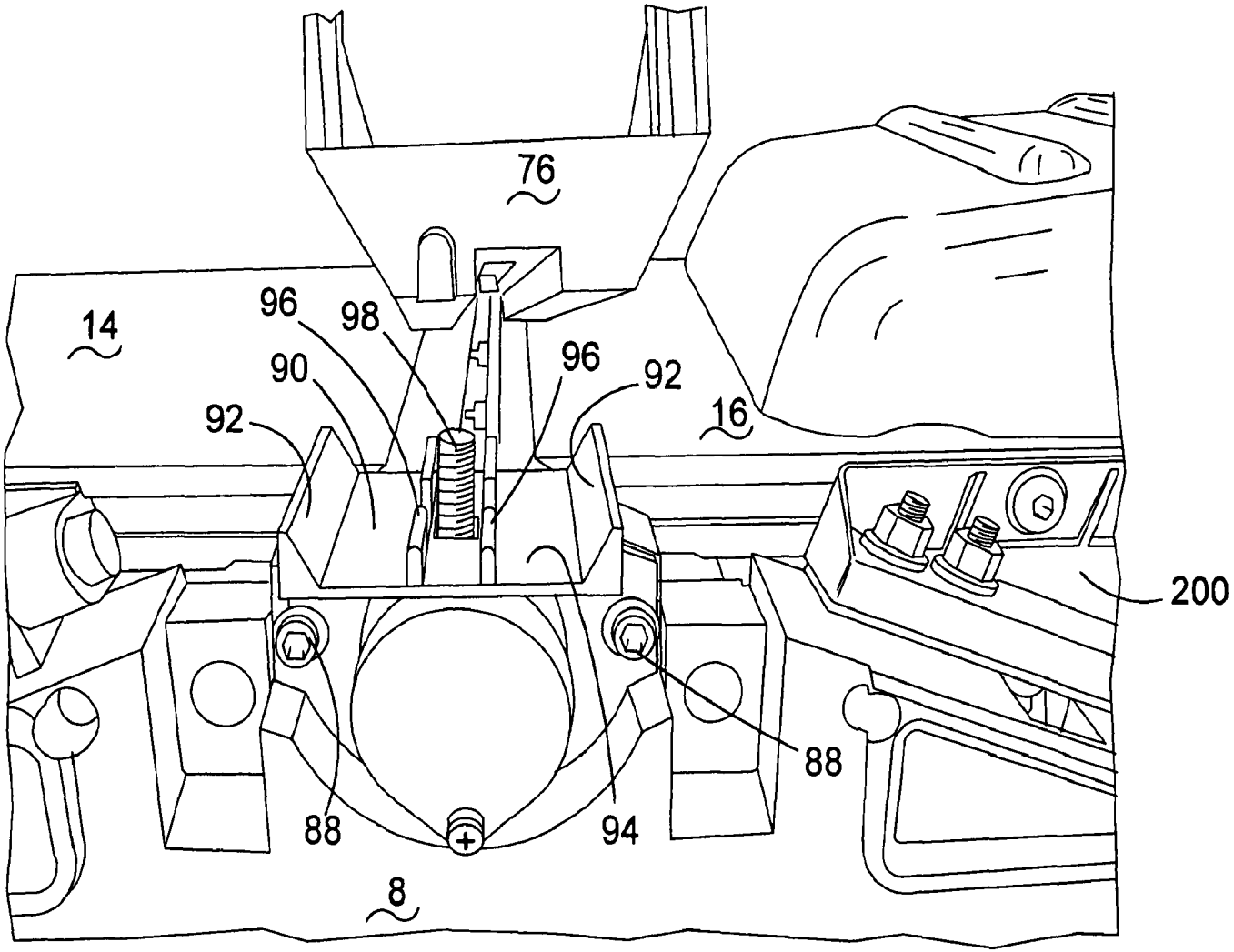
FIGS. 8 and 9 show a side view of a slide mechanism for the side fence assembly.
Figure 9:
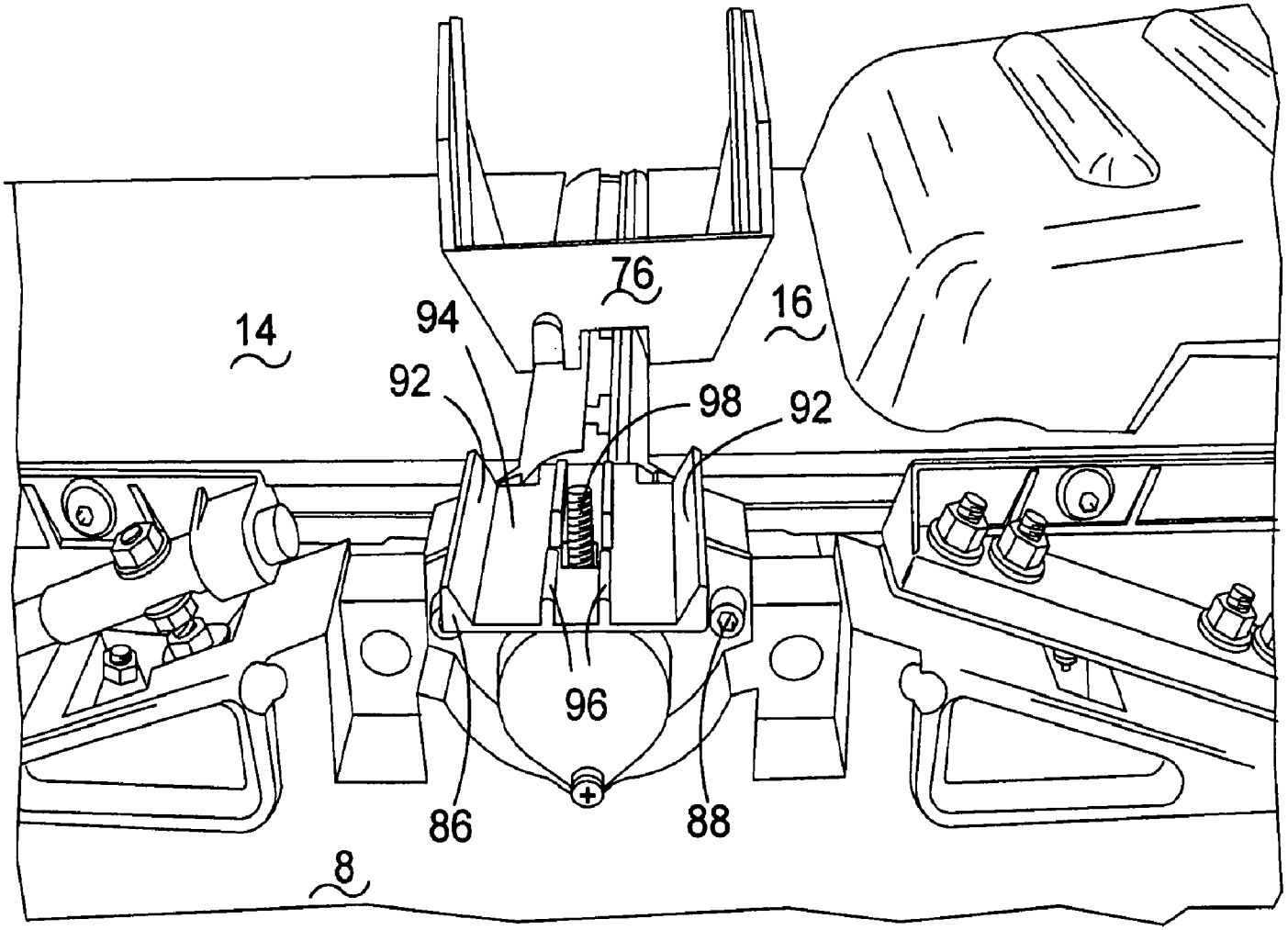

The slide mechanism will now be described in more detail with reference to FIGS. 5, 8 and 9.

In a preferred embodiment, the slide mechanism comprises the slide piece 76 and a guide support 86. The guide support 86 is mounted onto the side of the frame 2 of the planer and thicknesser adjacent to the side of the upper table 4 by the use of two bolts 88 which attach the guide support 86 to the side wall of the rectangular box frame 2.

The guide support 86 preferably comprises a channel 90 having a uniform cross-section which extends in parallel to the axis of rotation of the cutting drum 24. The channel 90 comprises two side walls 92 which are preferably angled relative to the vertical, the width of the channel 90 expanding in a direction away from the base 94 of the channel 90. The base 94 of the channel 90 is flat and horizontal. Two ridges 96 may run along the length of the channel as shown in a symmetrical fashion parallel to the longitudinal axis of the channel 90. A hole can be formed vertically through the guide support 86, the entrance of which is located centrally in the surface of the base 94 of the channel 90. A bolt 98 is located within the aperture, the head of the bolt (not shown) located below the guide support 86, the other end of the bolt projecting vertically upwards from the entrance of the aperture into the channel 90 as shown in FIGS. 7 and 8.

The guide support may be made from cast metal.

The shape of the underside of the slide piece 76 preferably corresponds to the shape of the channel 90 in the guide support 86. The slide piece 76 is located within the channel and is capable of sliding within the channel along its length. An elongate slot 100 may be formed centrally along a substantial part of the length of the slide piece 76 as shown in FIG. 5. The width of the slot is greater than that of the diameter of the bolt 98. When the slide piece 76 is mounted on the guide support 86, the bolt 98 may extend through the slot 100 as shown in FIG. 5. A nut (not shown) which has a diameter greater than the width of the slot 100 can be screwed onto the bolt 98. Preferably, a handle 102 surrounds the nut and is used to rotate the nut in order to screw it onto the bolt 98. The bolt 98 is prevented from rotating. When the nut is screwed securely onto the bolt 98, it sandwiches the slide piece 76 and the guide support 86 together preventing any relative movement. Similarly, when the nut is unscrewed from the bolt 98, the sandwiching force is removed allowing the slide piece 76 to slide within the guide support 86.

In a preferred use, an operator would loosen the nut on the bolt 98 by rotating the handle 102 and then sliding the slide piece 76 within the guide support 86, thus moving the guard 68 across the upper table 4. Once the guard 68 is located at the correct position on the upper table, the handle 102 is then rotated screwing the nut onto the bolt 98 sandwiching the slide piece 76 and the guide support 86 together.

The construction of the height adjustment mechanism for the front section of the upper table of a preferred embodiment of the present invention will now be described with reference to FIGS. 10 and 11.

In a preferred embodiment, the front section 14 of the upper table is capable of having its height adjusted. The front section 14 may be mounted on the rectangular box frame 2 using two slide guides as shown in FIG. 10. The slide guides can be mounted on either side of the front section 14. The slide guides allow the front section to be moved linearly at an angle to the horizontal to adjust the height of front section 14. The purpose of moving it at an angle is to compensate for the fact that the cutting drum 24, and hence the path swept out by the cutting blades 28 when the cutting drum 24 is rotated, is round. Thus, as the height of the front section 14 increases, the front edge of the front section, which forms the edge of the slot 18, needs to move towards the rear section 16 narrowing the slot 18 if the distance between the edge of the front section 14 and the cutting drum 24 is to be maintained. A drive mechanism may be incorporated to enable an operator to adjust the height of front section.

The description of the construction of one of the slide guides will now be given. The design of both of them is the same.

Figure 10:
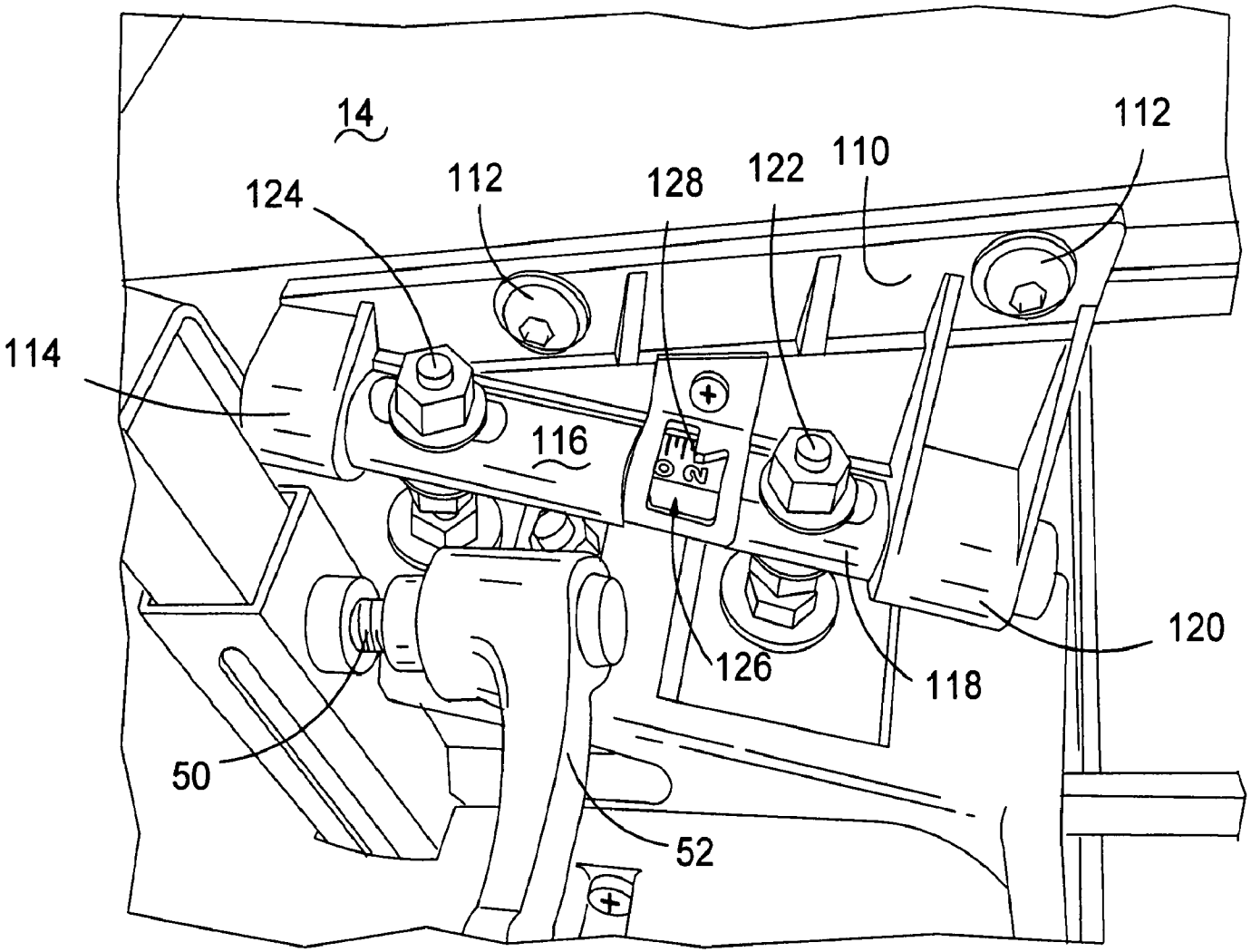
FIG. 10 shows a perspective view of a slide guide.
Figure 11:
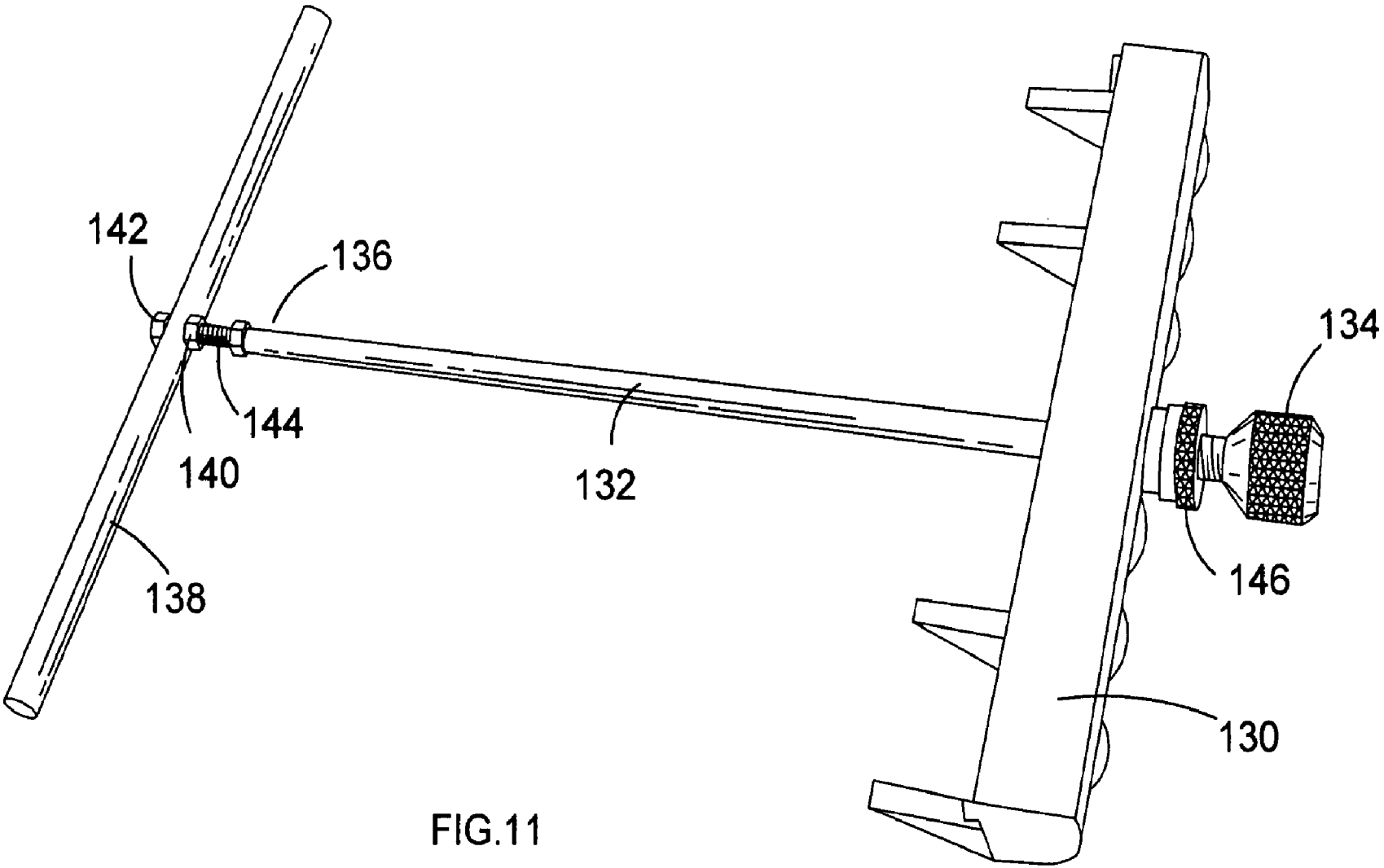
FIG. 11 shows a perspective view of a drive mechanism for controlling the movement of a front section of the upper table.

In a preferred embodiment, attached to one side of the front section 14, is a metal cast 110, as shown in FIG. 10. The metal cast 110 can be attached to the front section 14 by the two bolts 112. Formed on one end of the metal cast 110 is a protrusion 114 which has a socket (not shown) for receiving the end of a metal tube 116 of circular cross-section. The metal tube 116 may be rigidly fixed within the socket and movement between the two is prevented. A second metal tube 118 also of circular cross-section, but of smaller diameter than the first metal tube 116, can be mounted so that it is partially within the first metal tube 116. The second smaller metal tube 118 is co-axial with and able to telescope into and out of the first metal tube 116. Preferably, the second metal tube 118 extends from the end of the first metal tube 116 through a hole formed in a bracket 120 which is integral with the metal cast 110. The second metal tube 118 can freely slide within the hole of the metal bracket 120.

Preferably, a first bolt and nut 122 rigidly connects the second metal tube 118 to the top of the rectangular box frame 2. The bolt 122 prevents movement of the second metal tube 118 relative to the rectangular box frame 2. The height of the second metal tube 118 above the box frame can be altered by adjusting the nut on the bolt to raise or lower the second metal tube 118.

A second bolt 124, preferably, passes through an elongate slot formed through the sides of the first metal tube 116. The second bolt 124 can freely slide within the elongate slot. The second bolt 124 acts as a guide for the first metal tube 116 allowing it to slide axially while preventing it from moving sideways. Nuts screwed onto the bolt together with washers provide the means by which the tube is guided. The height of the first metal tube 116 above the box frame can be altered by adjusting the nut on the bolt 124 to raise or lower the first metal tube.

In a preferred embodiment, the two metal tubes act as a guide for the direction of movement of the front section 14 of the upper table when it is moved. The front section travels in a direction which is parallel to the longitudinal axes of the two tubes 116, 118. When the front section is pushed or pulled to the left or right, the second metal tube 118 either telescopes into or out of the first metal tube 116, the direction of movement being restrained by the interaction of the two metal tubes 116, 118. The angle of the two metal tubes can be adjusted by adjusting the nuts on the two bolts 122, 124, thus raising and lowering the heights of the first second tubes.

A painted scale 126 can be added onto the second metal tube 118 of one of the slide guides. A metal pointer 128 can also be added to the corresponding metal cast 110 which points towards the scale 126 and provides an indication of the height of the front section 14.

The drive mechanism by which the front section of the upper table is moved will now be described.

In a preferred embodiment, rigidly attached to the front end of the front section 14 of the upper table 4 is a plastic bumper 130. Passing through the plastic bumper 130 is a metal rod 132. The rod 132 may be arranged in such a manner that it can freely rotate within the plastic bumper 130 but cannot axially slide through the plastic bumper 130. A knob 134 can be attached to the end of the rod 132. Rotation of the knob 134 results in the rotation of the rod 132.

A hole is formed in the end 136 of the rod 132 which is opposite to the knob 134. The hole is co-axial with the rod 132. The inner wall of the hole may be threaded.

In a preferred embodiment, attached between the two walls 8, 10 of the rectangular box frame 2 is a second metal rod 138. A threaded bolt 144 may pass through a hole formed in the centre of the second rod 138 as shown in FIG. 11. A nut 140, in conjunction with the head 142 of the bolt 144, holds the metal bolt 144 in position in relation to the second rod 138. The end 136 of the first rod 132 with the hole is screwed onto the threaded section of the bolt 144. Rotation of the first rod 132 results in the first rod 132 being screwed onto the bolt 144 causing the rod 132 together with the plastic bumper 130 to move as the rod screws onto the bolt 144. Rotation of the knob 134 in a first direction results in the rod 132 and plastic bumper 130 and knob 134 moving in a first direction and rotation of the knob 134 in the opposite direction results in the rod 132 together the plastic bumper 130 and knob 134 moving in the second direction. As a first section 14 of the upper table is connected to the plastic bumper 130, movement of the bumper results in movement of the front section 14 of the upper table 4.

Preferably, a locking nut 146 is threadably attached to the rod between the knob 134 and the plastic bumper 130. Rotation of the locking nut 146 causes it to engage the plastic bumper 130 and to pull the rod 132 through the plastic bumper 130. However, the plastic bumper 130 and rod 132 are arranged so that no axial movement is allowed between the two, only rotational. This causes the locking knob 146 to lock the rod 132 and prevents any rotation thereof.

The drive mechanism is used to move the front section 14 backwards and forwards by rotation of the knob 134. The slide guide is used to control the direction of movement, the direction being restricted to that of the longitudinal axis of the two metal tubes 116,118.

The drive mechanism for the planer and thicknesser will now be described with reference to FIGS. 12 and 13.

Figure 17:
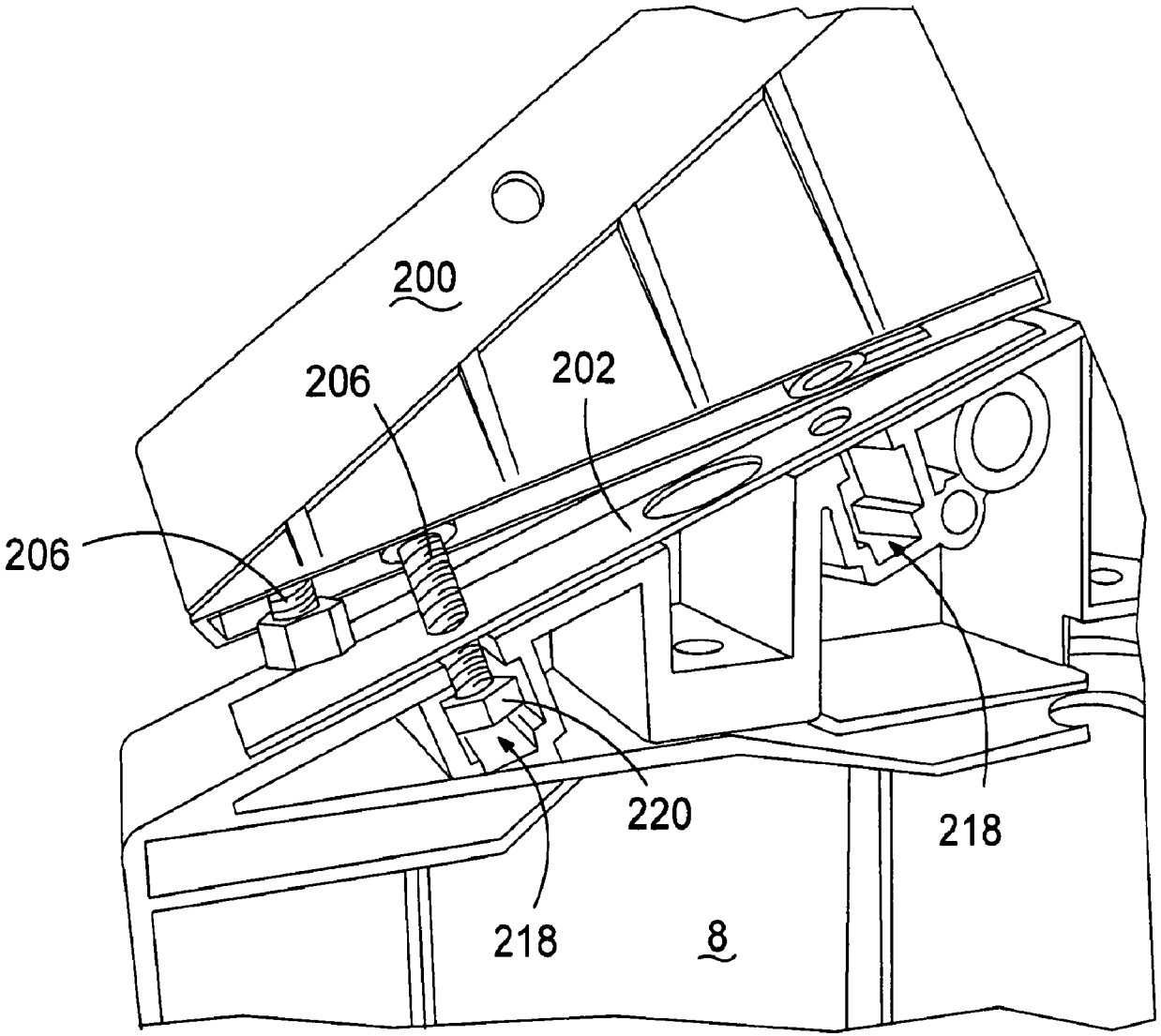

In a preferred embodiment, an electric motor (not shown) is mounted within the base 6 of the box frame 2. Two bolts 150 can be used to attach the electric motor to the side of the frame which can be slackened off in order to adjust the position of electric motor. As can be seen in FIG. 17, the spindle 152 of the electric motor projects through an aperture in the side wall of the rectangular box frame 2.

Figure 12:
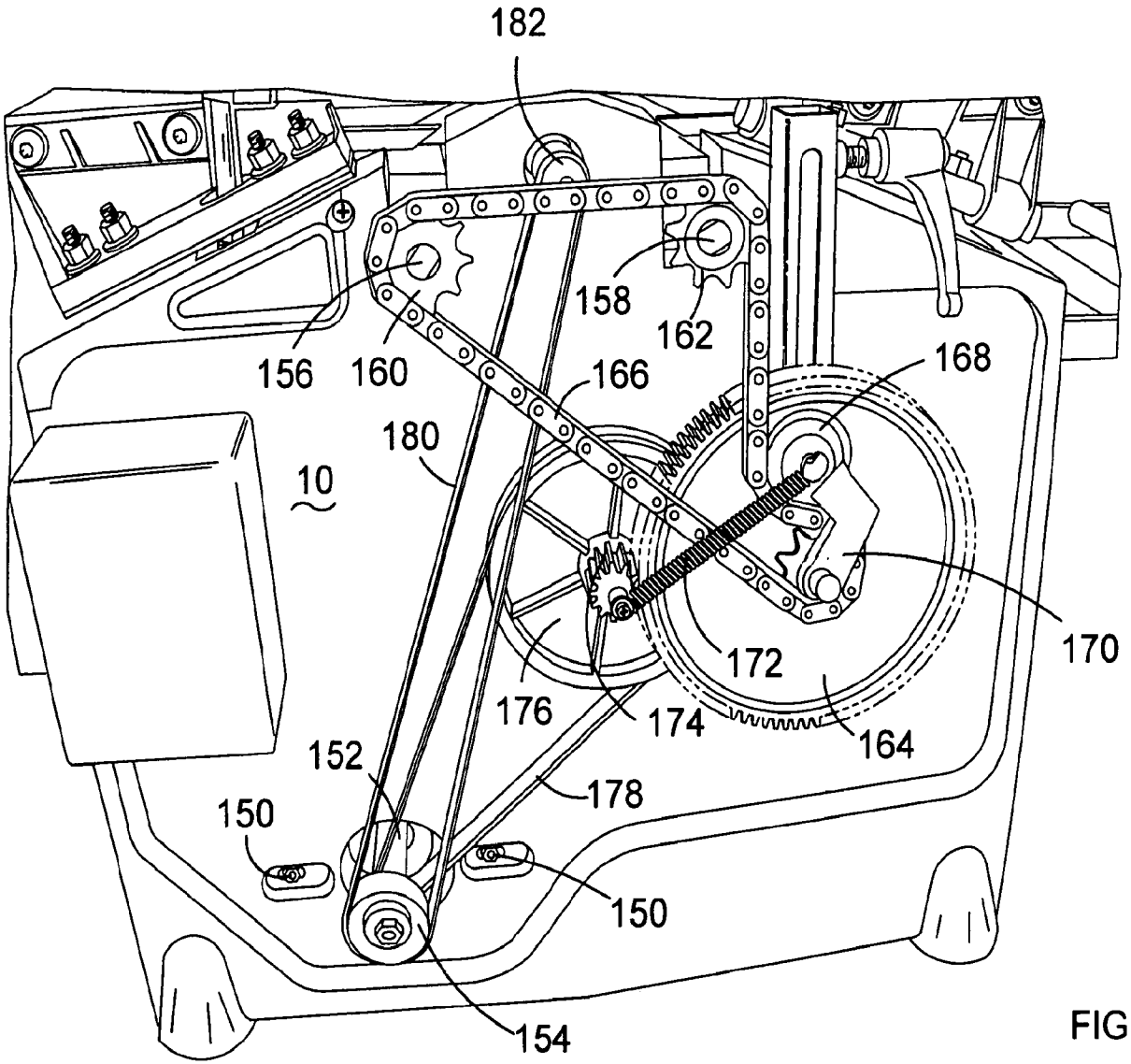
FIG. 12 shows a perspective view of a drive mechanism for two rollers and the cutting drum.

Two wheels 154 may be rigidly mounted adjacent to each other on the spindle 152 as shown in FIG. 12.

Figure 13:
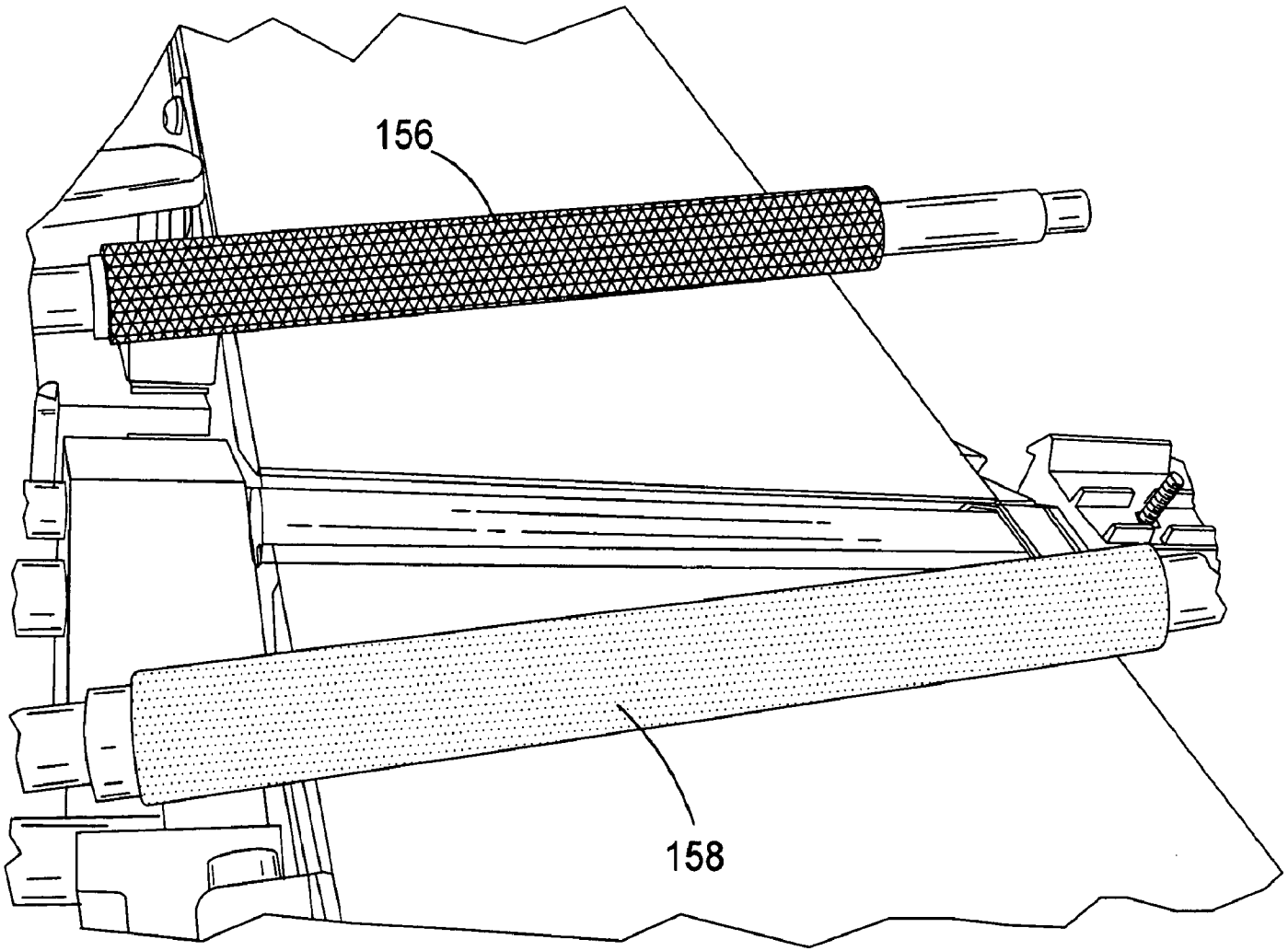
FIG. 13 shows a perspective view of the two rollers.

Two rollers 156, 158, as shown in FIG. 13, can be mounted on either side of the cutting drum 24 in such a manner that their axes of rotation are parallel to each other and to the axis of rotation of the cutting drum 24. The first roller 156 is preferably constructed from a metal rod of circular cross section and has a knurled surface. The second roller 158 is preferably constructed from a metal rod of circular cross section and is surrounded by rubber. Mounted on one of the ends of the two rollers are cogs 160, 162 as shown in FIG. 12.

Rotatably mounted onto the side of the wall of the rectangular box frame is a first gear 164. Integrally formed with the first gear 164 is a cog which is coaxial with the axis of rotation of the first gear 164. In a preferred embodiment, a chain 166 wraps around the cog of the first gear 164 and the two cogs 160,162 on the ends of the two rollers 156,158. Rotation of the first gear 164 results in rotation of the cog of the first gear 164 which in turn causes the two cogs 160,162 and hence the two rollers 156,158 to rotate. An adjustment cog 168 is rotatably mounted upon arm 170 which is pivotally attached to the first gear 164 and which can pivot about the axis of rotation of the first gear 164. The spring 172 biases the cog 168 into engagement with the chain 166 which causes the chain 166 to be tightened. The adjustment cog 168 is used to ensure that the chain 166 is maintained at the correct tension.

In a preferred embodiment, a second gear 174 meshes with the first gear 164. The second gear 174 is rotatably mounted on the side wall of the rectangular box frame 2. The second gear 174 is integrally formed with a wheel 176. A rubber band 178 passes around the wheel 176 and around one of the wheels 154 mounted on the spindle 152 of the motor. Rotation of the spindle of electric motor results in rotation of the wheel 176 due to the rubber band 178. This results in rotation of the second gear 174 which in turn drives the first gear 164. Thus, rotation of electric motor results in rotation of the two rollers 156, 158.

A second rubber band 180 connects the other wheel 154 mounted on the spindle 152 of the motor and the axle 182 upon which the cutting drum 24 is mounted within the rectangular box light frame 2. Thus, rotation of the spindle of electric motor results in rotation of the cutting drum 24.

Preferably, the various wheels are sized and arranged so that the correct speeds for the two rollers and for the cutting drum are achieved by the rotation of electric motor.

The height adjustment mechanism of the lower table will now be described with reference to FIGS. 1, 4, 14 and 15.

In a preferred embodiment, the lower table 20 has four apertures formed through the four corners of the table 20, the longitudinal axes of the four apertures being vertical. The cross-section of each of the four apertures may be circular, the inner walls of the aperture may be threaded along the length of the aperture. A threaded rod 190 passes through each of the four apertures, the thread of the rod 190 engaging with the thread of the aperture. Each of the four rods 190 is rotatably mounted vertically within the box like frame 2 and is capable of being rotated about its longitudinal axis. Rotation of each of the four rods 190 results in the lower table 20 moving along the length of rod 190 due to interaction of the threads on each of the rods 190 and the walls of the aperture in lower table 20.

Figure 14:
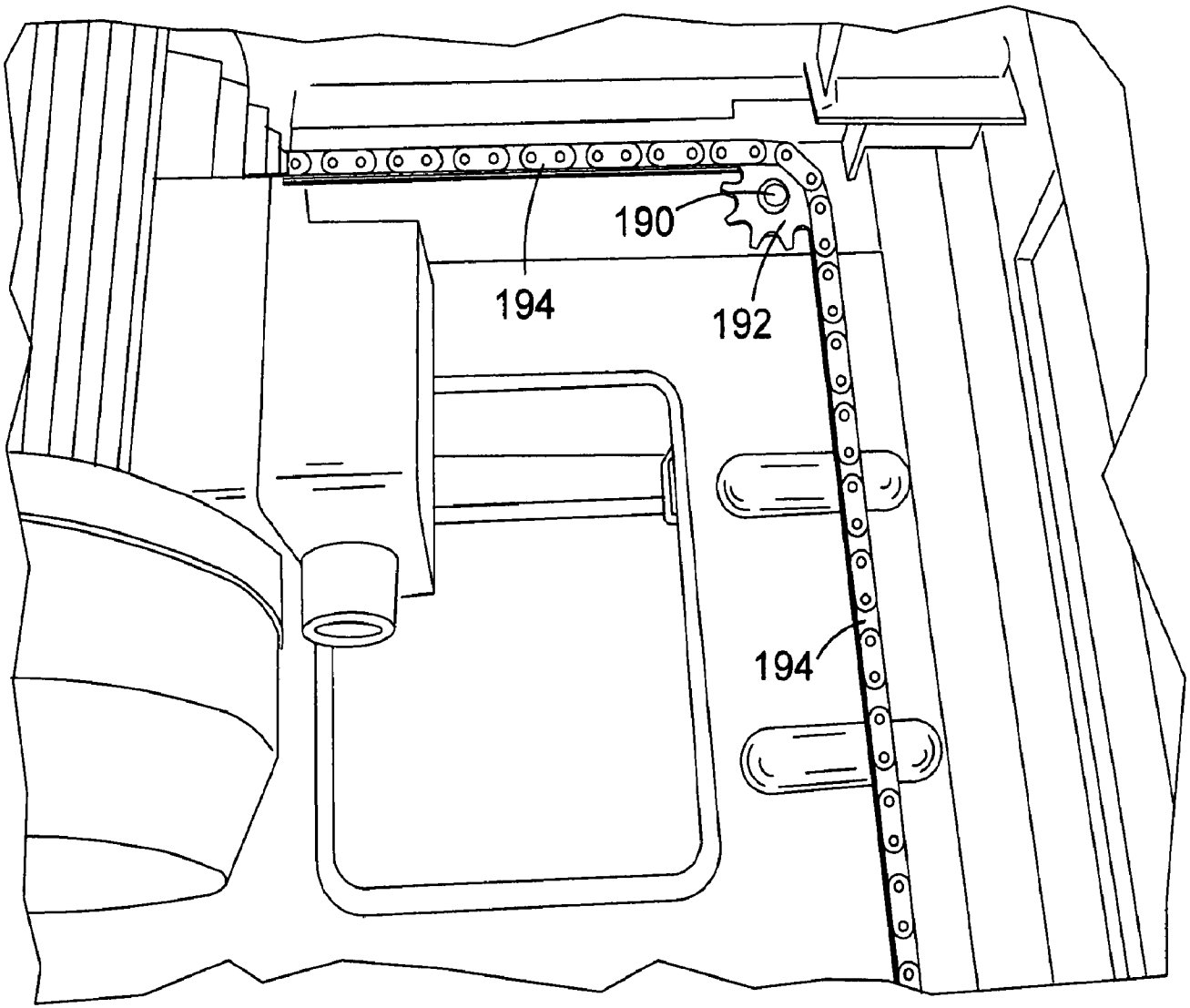
FIGS. 14 and 15 show a perspective view of a height adjustment mechanism for a lower table.
Figure 15:
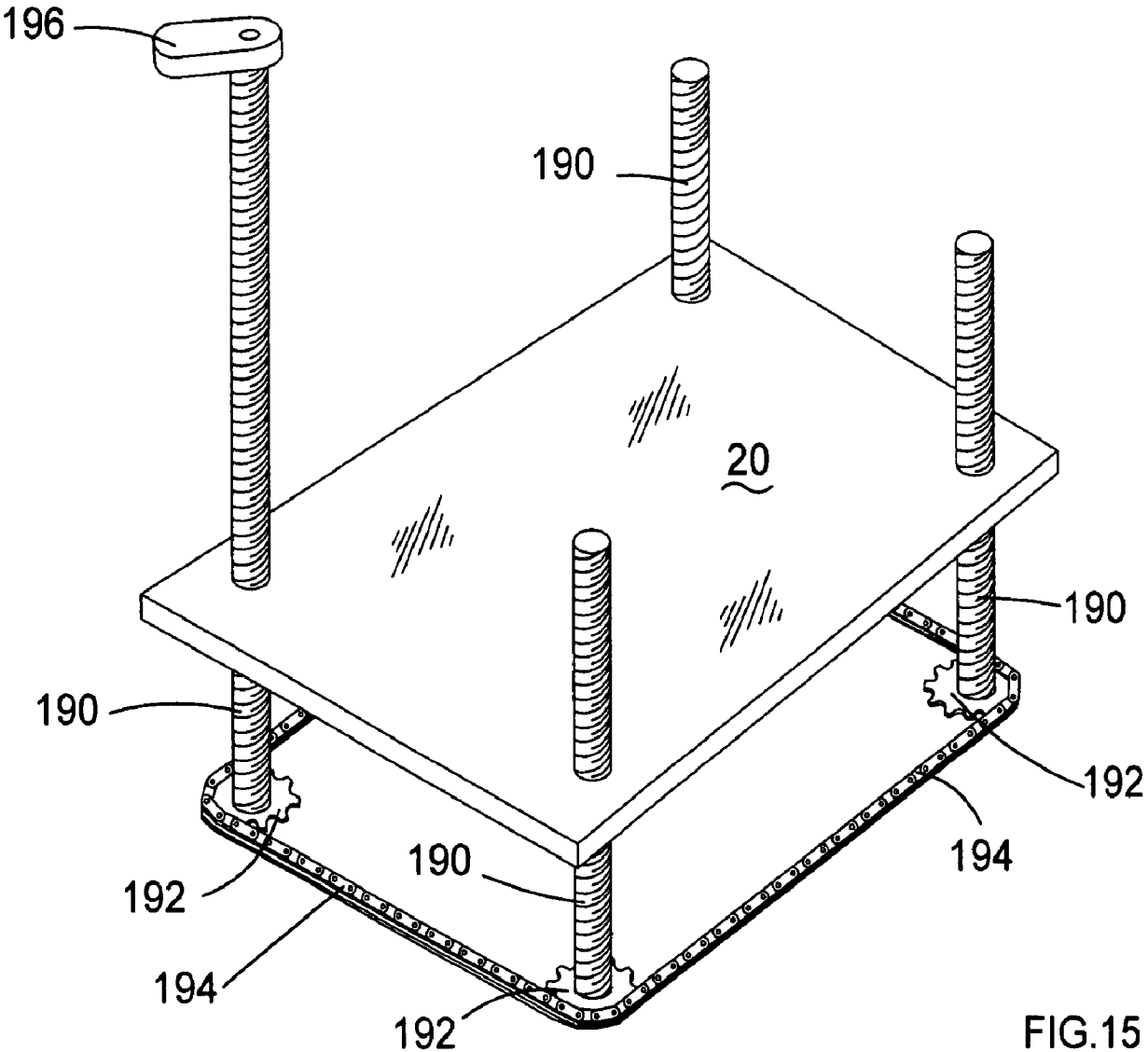

Mounted on the lower end of each of the rods is a cog 192 as shown in FIGS. 14 and 15. Preferably, a chain 194 wraps around all four cogs such that rotation of one rod results in rotation of all four rods 190. This ensures that the lower table 20 is moved up and down the uniform fashion at all four corners. When the planer and thicknesser is assembled, the lower table is mounted onto the four rods 190 so that it is substantially horizontal.

In a preferred embodiment, one rod 190 extends from within the inside the rectangular frame through the top surface of the frame. A handle 196 is mounted on the top of that rod 190 and the operator would rotate the handle 196 causing the rod 190 attached to the handle 196 to rotate, which in turn rotates all four rods 190 due to the chain 194. As the rods 190 rotate, the lower table is lifted or lowered as the lower table is screwed up or down.

The rear section mounts will now be described with reference to FIGS. 16 and 17.

In a preferred embodiment, the rear section 16 of the upper table 4 is rigidly mounted to the top of the rectangular box like frame 2 of the planer and thicknesser. The rear section 16 may be attached to the frame using two mounts, one located on either side of the rear section. Each mount comprises a metal cast 200, a metal plate 202, four mounting nuts 204, bolts 206 and washers 208, and two attachment bolts 210 and washers 212.

Figure 16:
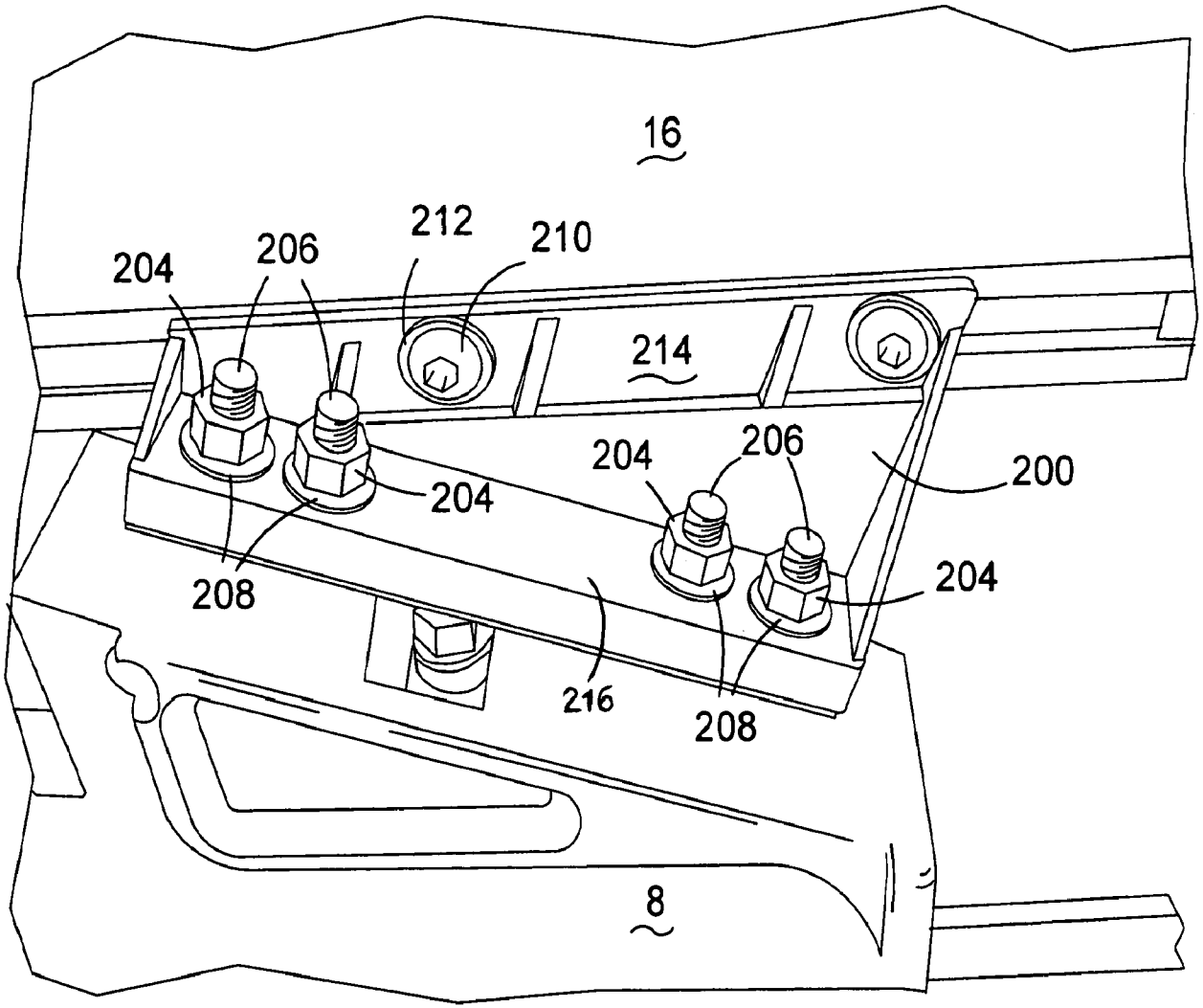
FIGS. 16 and 17 show a perspective view of a mounting mechanism for a rear section of the upper table.

Each metal cast 200 comprises a vertical wall 214 connected to a horizontal base 216 as shown in FIG. 16. The vertical wall 214 of the metal cast 200 comprises two holes. The metal cast 200 is attached to the side of the rear section 16 using two attachment bolts 210 which pass through the two holes in the vertical wall 214, through the washers 212 and then are of screwed into the side of the rear section 16.

Preferably, four holes are formed through the horizontal base 216 through which the mounting bolts 206 will pass.

Formed in the upper part of each of the side walls 8, 10 of the rectangular box frame 2 are two slots 218 which are each intended to receive a head 220 of one of the mounting bolts 206, as shown in FIG. 17.

The metal plates 202 comprises two holes through which the mounting bolts 206, which will have their heads 220 located within the slots 218 in the side walls 8,10, will pass. When the metal cast 200 is attached to the top of the wall 8, 10, the metal plate 202 is sandwiched between the lower surface of the metal cast 200 and the upper surface of the wall 8, 10. Preferably, the head 220 of the two mounting bolts 206 are located in the two slots 218 formed in the upper wall, the shaft of the bolts passing through apertures in the metal plate 202 and then through two apertures in the base of the metal cast 200. The two other bolts 206 pass through the two remaining apertures in the base of the metal cast, the heads of those bolts are, preferably, sandwiched between the lower surface of the metal cast 200 and the upper surface of the metal plate 202. Mounting nuts 204 are then screwed onto the ends of the bolts 206 sandwiching the washers 208 against the upper surface of the base 216 of the cast, as shown in FIG. 16.

By adjusting the tightness of the nuts 204 on the mounting bolts 206, the position of the heads of the bolts can be adjusted slightly, thereby creating a biasing force on the plate 202 as it is flexed slightly due to the positions of the heads of the bolts 206. This allows a slight amount of movement of the metal cast 200 relative to the side wall 8, 10 of the frame. Therefore, by adjusting the bolts 206, the metal cast 200 can be angled correctly to enable the rear section 16 of the upper table 4 to be adjusted so that it is horizontal.

Figure 18:
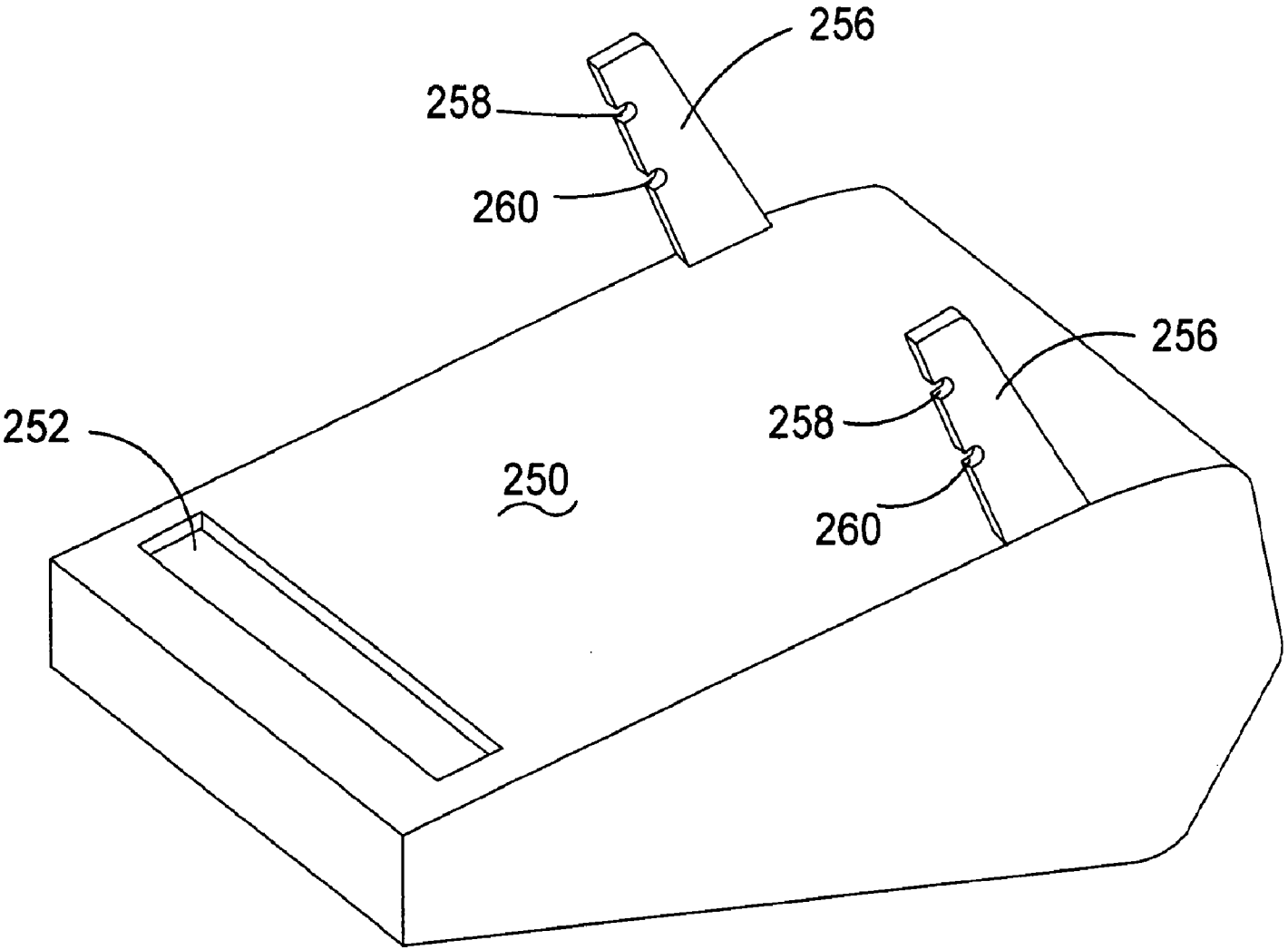
FIG. 18 shows a top perspective view of a dust extractor.

The dust extractor will now be described with reference to FIGS. 18, 19 and 20.

In a preferred embodiment, the dust extractor comprises a plastic box 250 having on its upper surface at one end a rectangular aperture 252 formed through the upper wall across the width of the box. Located at the other end of the plastic box on the lower surface of the box is a tube 254 of circular cross-section which extends downwardly. The tube 254 is aligned with a circular aperture within the wall of the box 250 so that air and any entrained debris can pass through the tube and into the box. Preferably, two arms 256 mounted on the side of the box extend upwardly from the box 250. Two horizontal slots 258,260 are formed within the arms 256 as shown in FIGS. 18, 19 and 20. The dust extractor can be attached to the top of the thicknesser and planer or underneath depending on which mode of operation the planer and thicknesser is being used.

Figure 20:
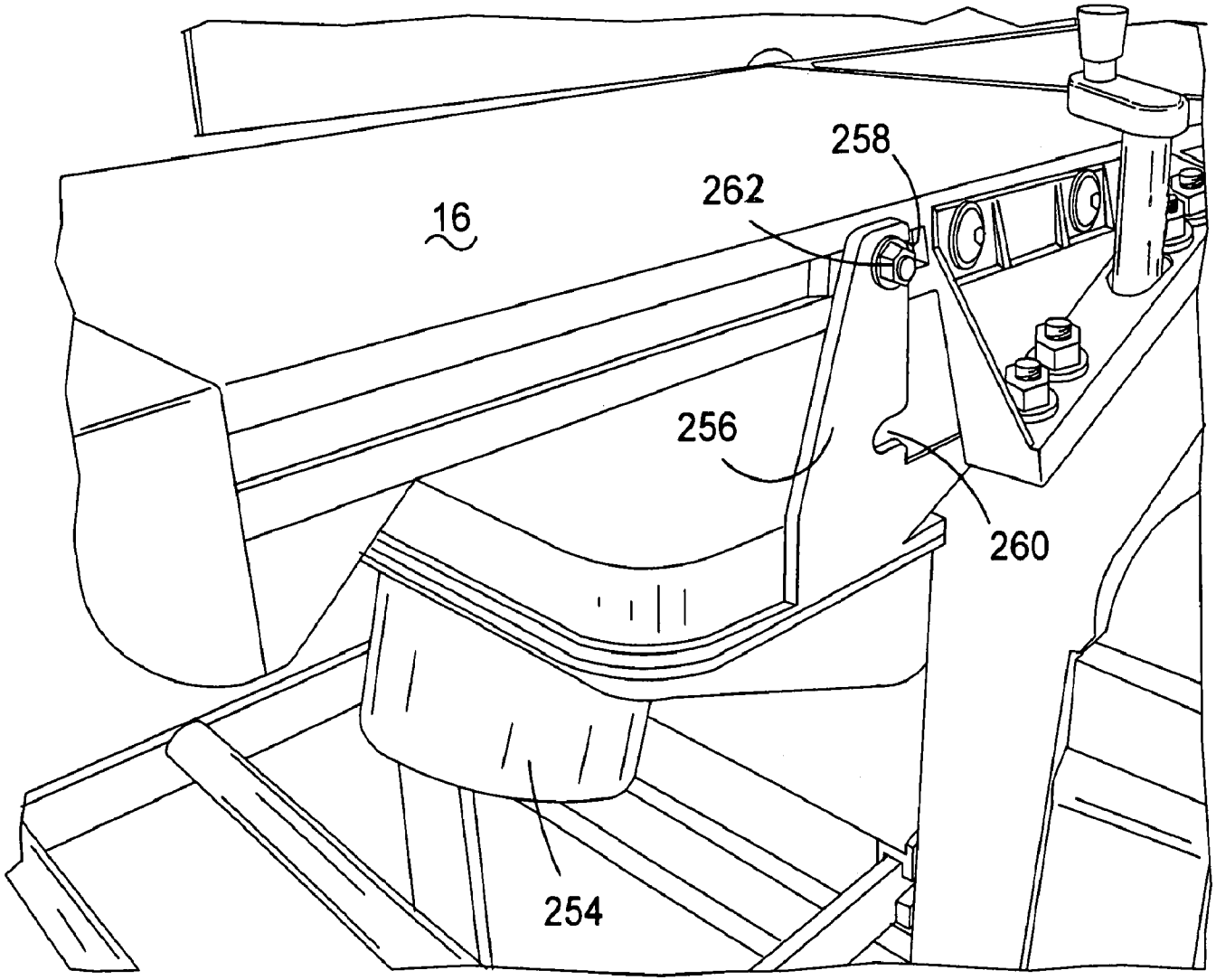
Figure 21:
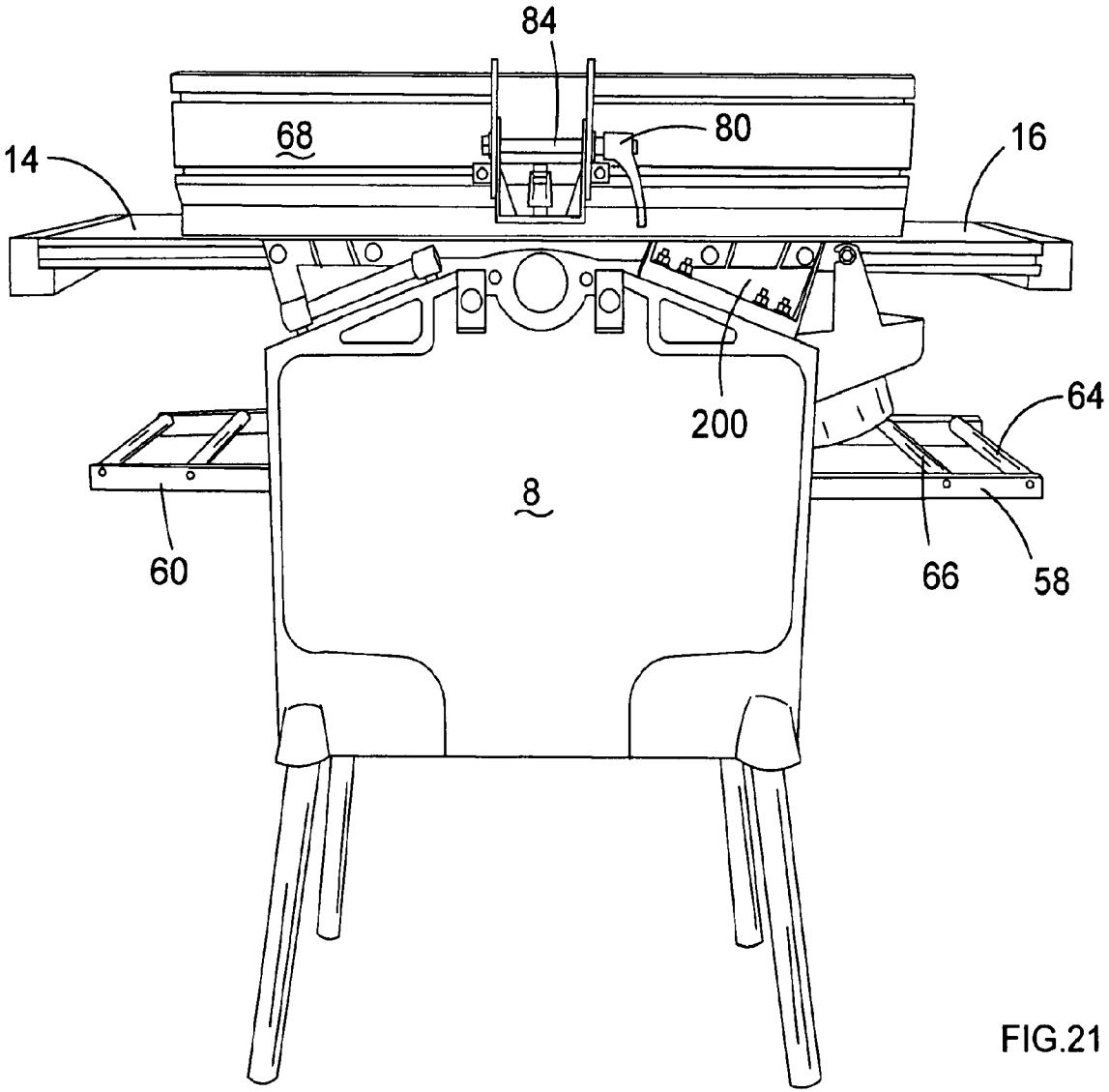
FIG. 21 shows a rear view of the planer and thicknesser.
Figure 22:
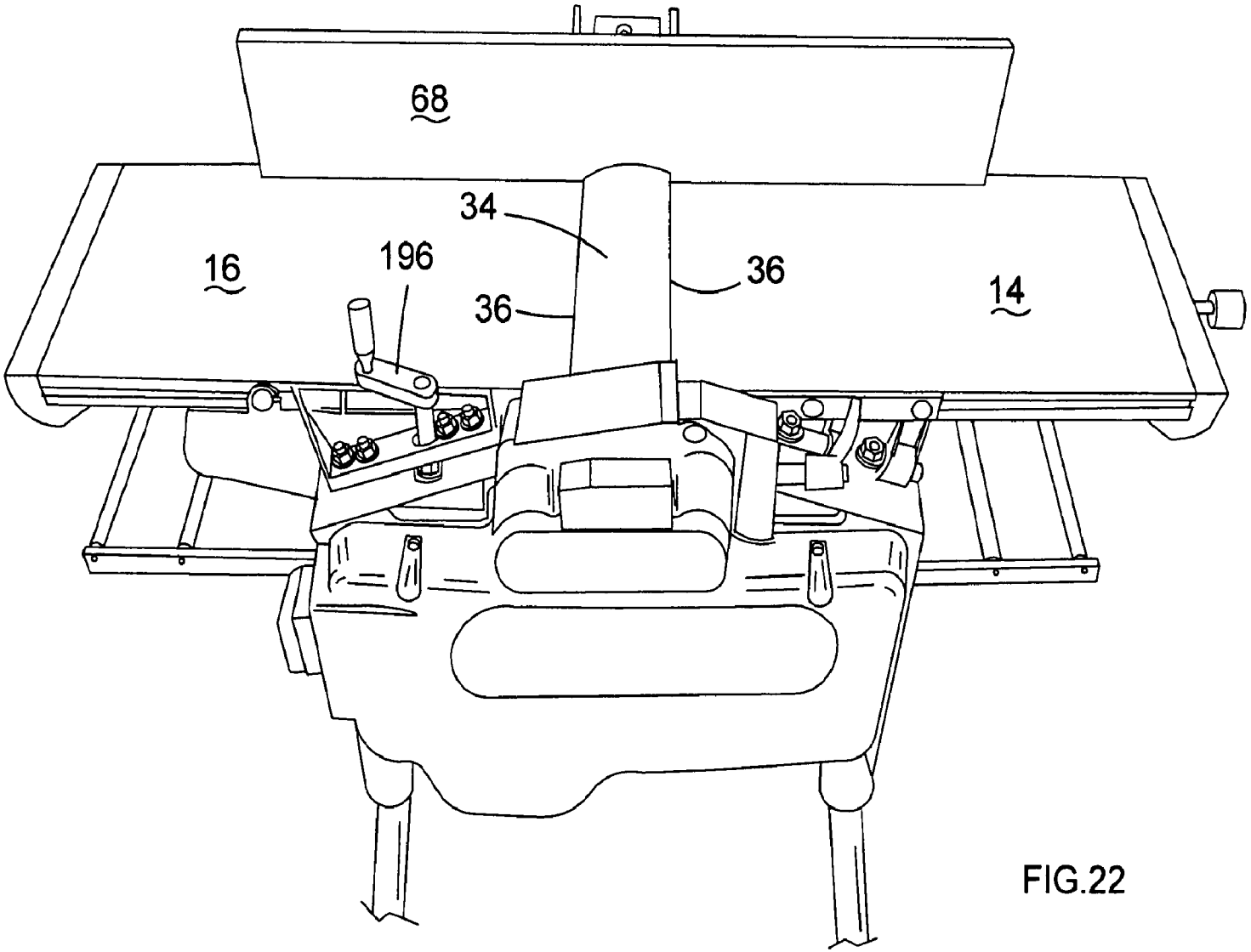
FIG. 22 shows a downward front perspective view of the planer and thicknesser.
Figure 23:
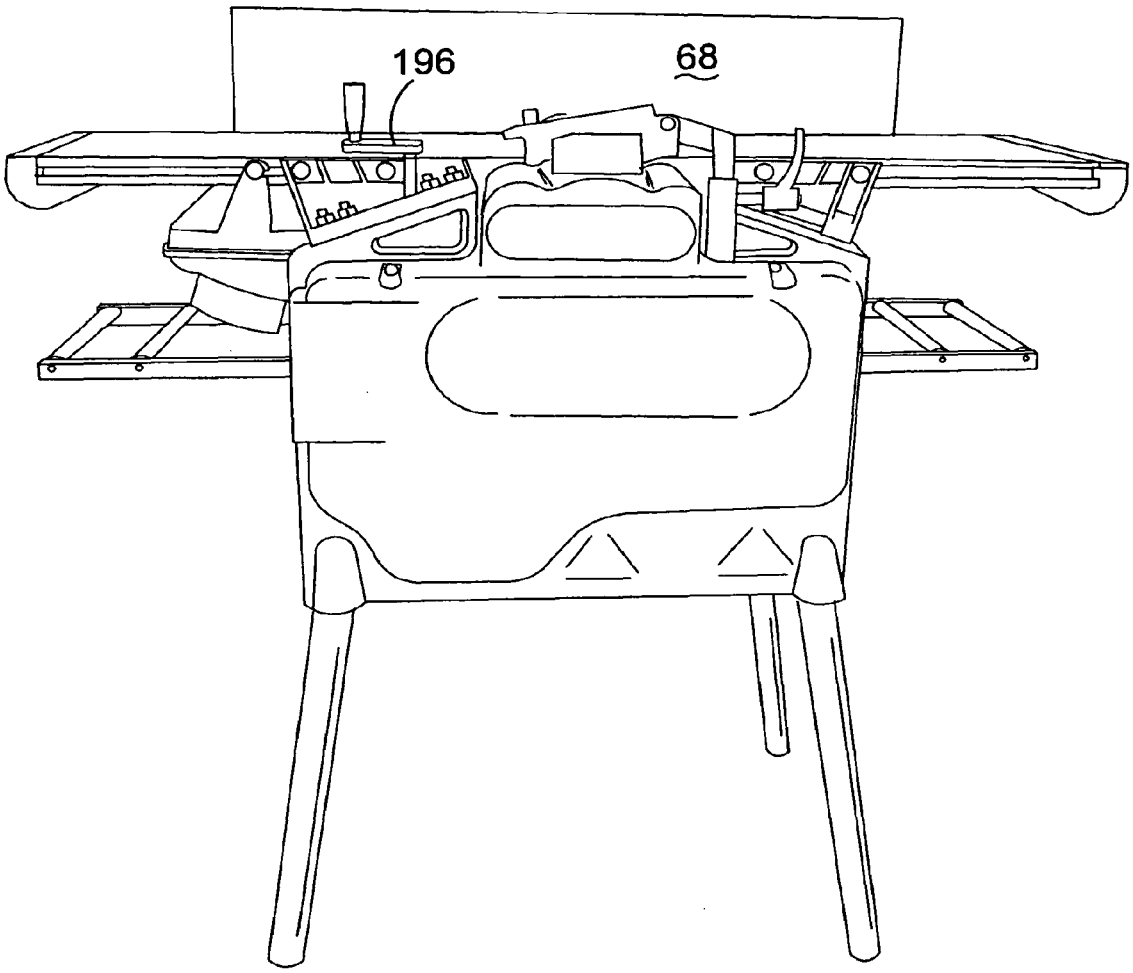
FIG. 23 shows a front view of the planer and thicknesser.
Figure 24:
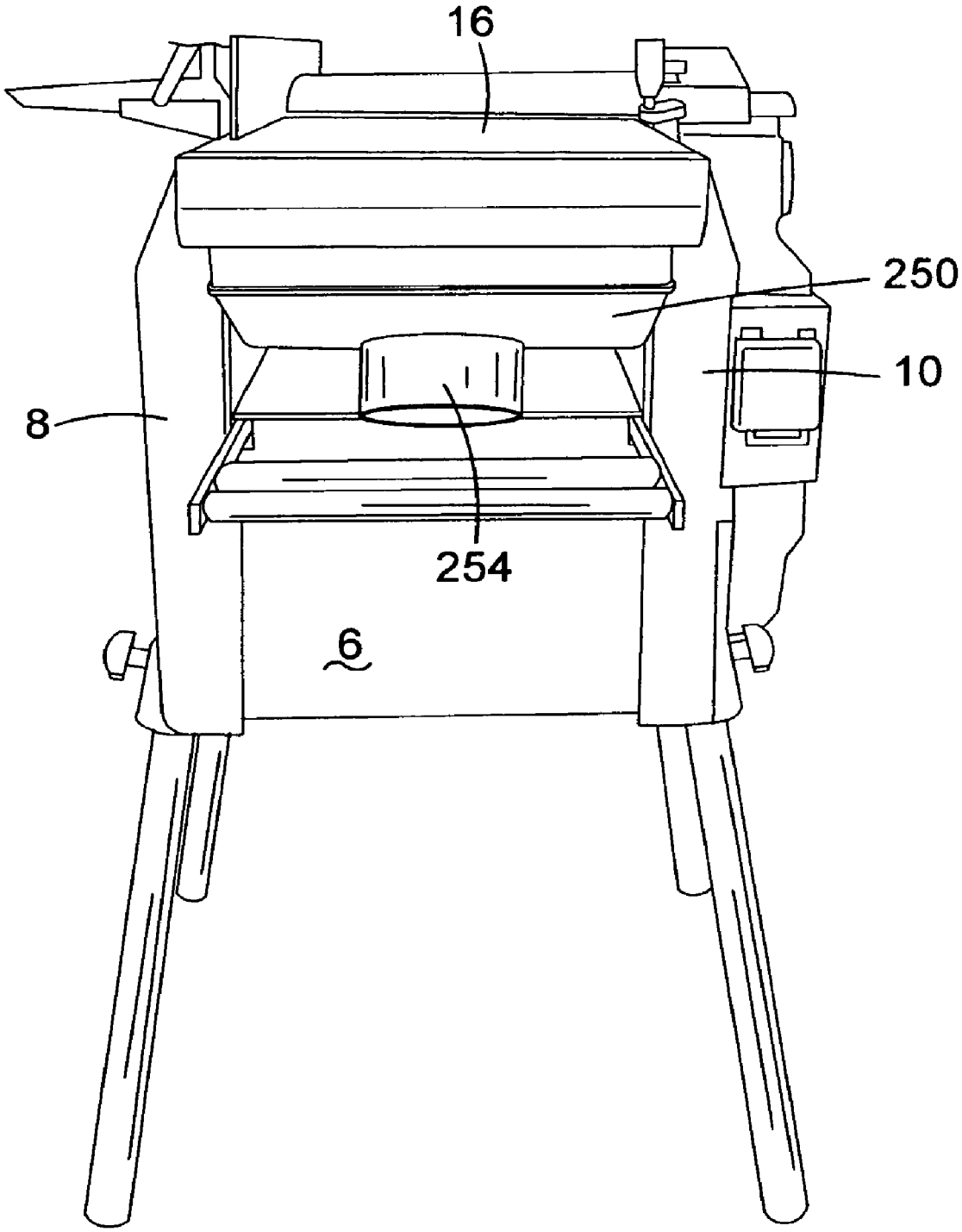
FIG. 24 shows a side view of the planer and thicknesser.
Figure 25:
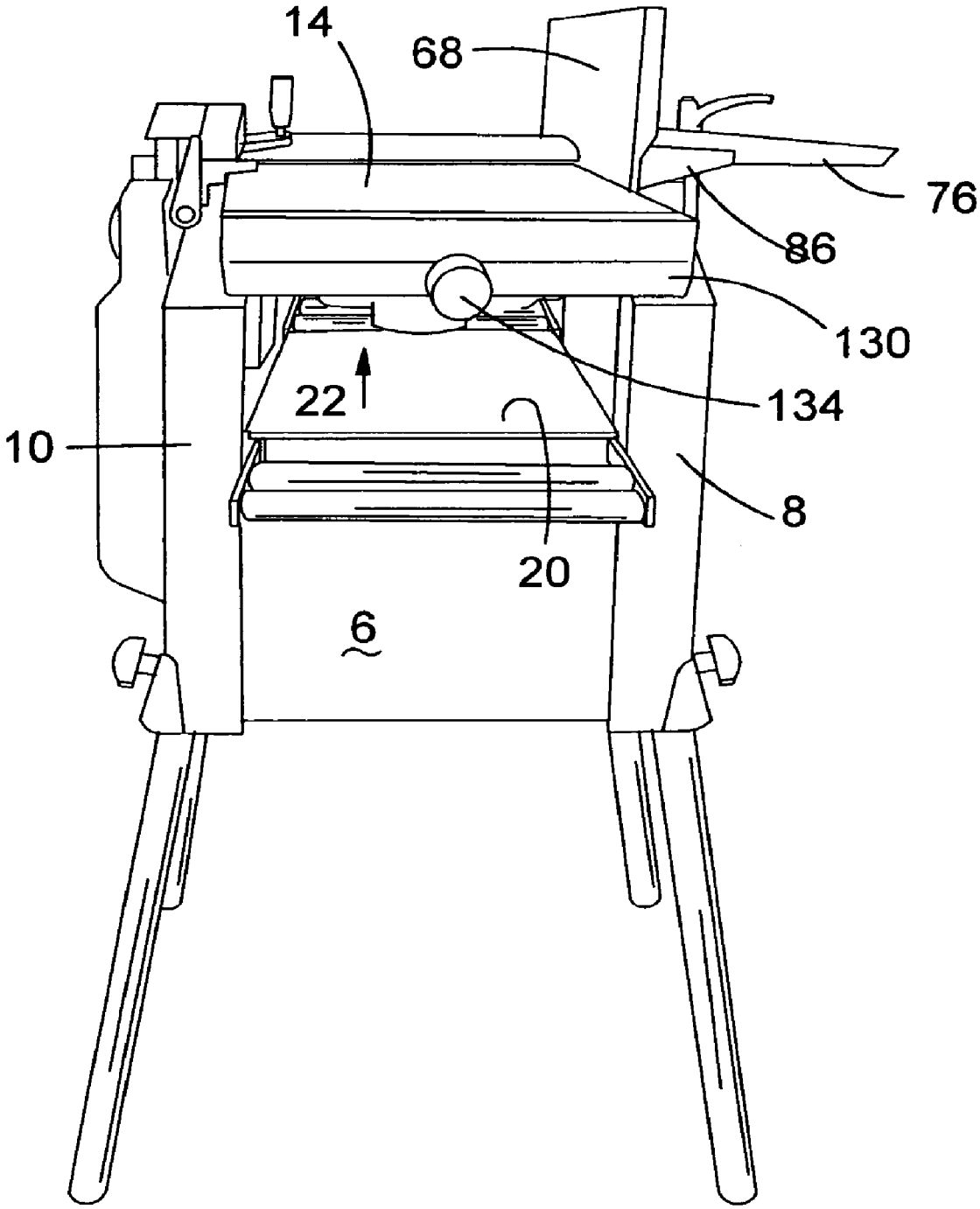
FIG. 25 shows a second side view of the planer and thicknesser.

In the first mode of operation, the dust extractor is connected to the underside of the rear section 16 of the upper table as shown in FIG. 20. Bolts 262 screwed into the side of the rear section 16 pass through the upper slots 258 of the arms 256. The bolts 262 are used to sandwich and hold the arm 256 against the side of the rear section 16. The rectangular aperture 252 is aligned with the underside of the rotating cutting drum 24. A vacuum cleaner is then attached to the tube 254. As a work piece is cut on the upper table 4, the chips formed pass through the rectangular aperture 252 and into the box and are then sucked out through the circular tube 254.

Figure 19:
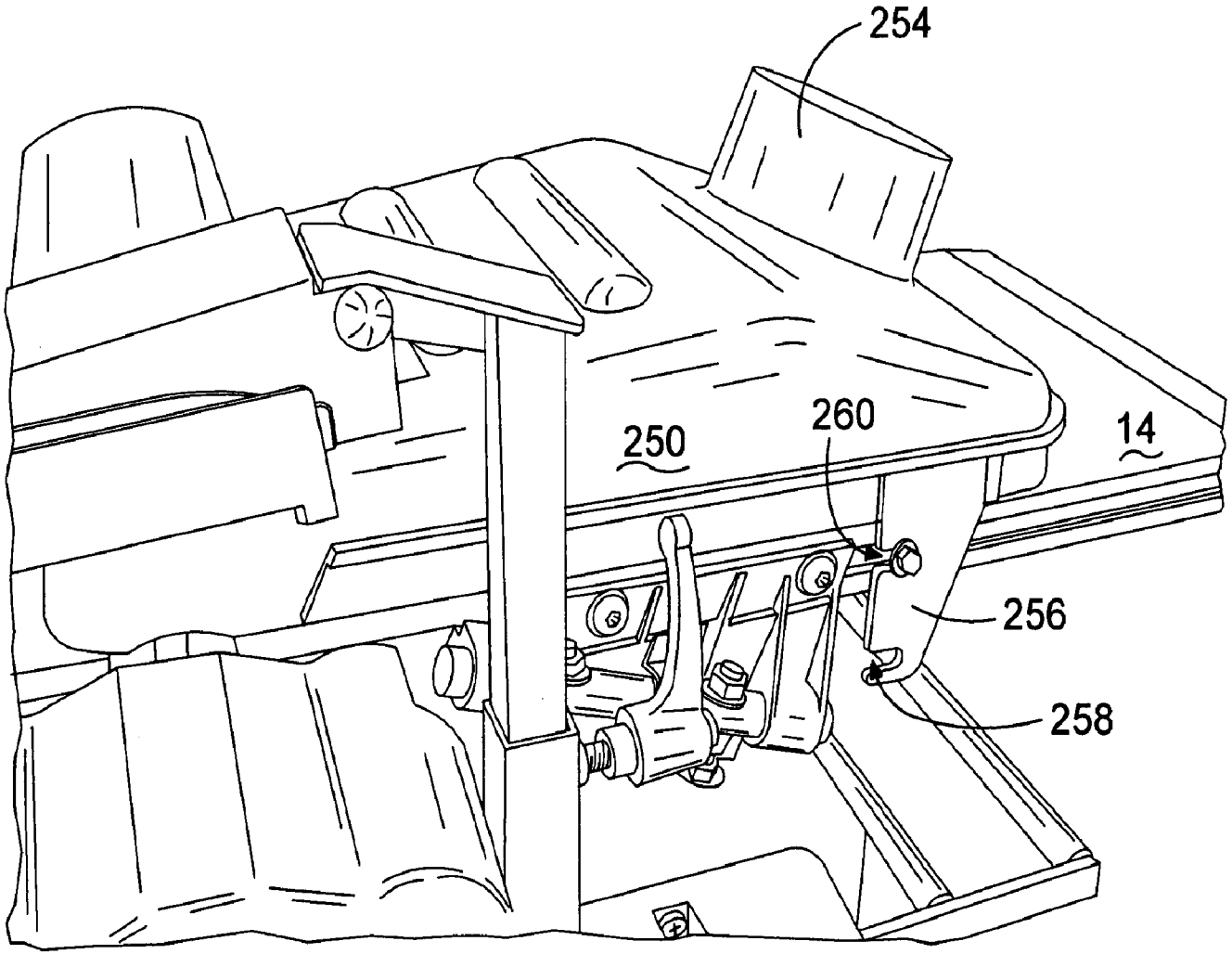
FIGS. 19 and 20 show the dust extractor located above and below the upper table respectively.

When the planer and thicknesser is used in the second mode of operation, the dust extractor is located on top of the front section 14 of the upper table 4, bolts 262 passing through the lower slots 260 of the arms are used to sandwiched the arms 256 against the sides of the upper table 4 are shown in FIG. 19. Again, the rectangular aperture 252 is aligned with the cutting drum 24. As a work piece is passed over the lower table, any chips which are removed by the rotating cutting drum 24 pass through the rectangular aperture 252 and into the box 250. The vacuum cleaner is attached to the circular tube 254 in order to remove the chips from the box 250.

Whereas particular embodiments of the invention have been described herein for the purpose of illustrating the invention and not for the purpose of limiting the same, it will be appreciated by those of ordinary skill in the art that numerous variations of the details, materials, and arrangement of parts may be made within the principle and scope of the invention without departing from the invention as described in the appended claims.

The invention claimed is:

1. A planer and thicknesser comprising:

a frame having a passageway that substantially extends through the frame from a first aperture in a first wall of the frame to a second aperture in a second wall of the frame;

an upper table, having a front section and a rear section connected to the frame;

a slot located between the front section and the rear section of the upper table;

a cutting drum rotatably connected to the frame such that a first portion of the cutting drum extends through the slot and a second portion of the cutting drum extends into the passageway;

a lower table, movably connected within the passageway;

a side fence assembly for guiding a work piece across the upper table, the side fence assembly comprises a pivotal guard, wherein the pivotal guard is connected to the frame through a tilt mechanism.

2. The planer and thicknesser of claim 1, wherein the tilt mechanism comprises:

at least one bracket connected to the guard;

at least one bracket connected to the frame;

at least one of the brackets comprising an arcuate slot;

at least one of the brackets comprising an aperture; and a holding member, wherein the brackets are moveable relative to each other so that the aperture of one bracket can be aligned with any part of the arcuate slot of another bracket and wherein the holding member passes through the aperture and arcuate slot of the brackets and is capable of releasably locking one bracket to the other bracket to prevent any relative movement between the brackets.

3. The planer and thicknesser of claim 2, wherein the tilt mechanism further comprises:

two brackets, each including at least one arcuate slot; and two brackets, each including at least one aperture, wherein each of the brackets having an arcuate slot are aligned with a bracket having an aperture.

4. The planer and thicknesser of claim 3, wherein the tilt mechanism further comprises:

two holding members, each passing through the aperture and the arcuate slot of the brackets, wherein each of the holding members locks two brackets together by applying a force to the brackets to frictionally engage the brackets.

5. The planer and thicknesser of claim 2, wherein the holding member further comprises:

a nut; and a bolt which passes through the aperture and the arcuate slot of the brackets, wherein the nut is screwed onto the bolt, exerting a force on the two brackets thereby preventing relative movement between the two brackets.

6. The planer and thicknesser of claim 1, wherein the side fence assembly further comprises:

a slide mechanism that allows the guard to move with respect to the upper table, the slide mechanism further comprises a slide piece connected to a guide support;

the guide support comprises a channel having outwardly sloping walls; and a locking mechanism, wherein a portion of the slide piece is located within the channel and is capable of sliding along the channel and wherein the locking mechanism can lock the guide support to the slide piece.

7. The planer and thicknesser of claim 6, wherein the channel comprises at least one ridge which runs along at least a portion of the length of the channel.

8. The planer and thicknesser of claim 6, wherein the locking mechanism comprises a projection member that extends from the base of the channel through a slot formed in the slide piece which enables the guide support and the slide piece to be force fit together to prevent relative movement between the guide support and the slide piece.

9. The planer and thicknesser of claim 8, wherein the projection member comprises a bolt onto which a nut can be threadably attached to force fit the guide support to the slide piece.

* * * * *